US009221268B1

(12) United States Patent
Mochizuki

(10) Patent No.: US 9,221,268 B1
(45) Date of Patent: Dec. 29, 2015

(54) PRINTING APPARATUS

(71) Applicant: Hiroshi Mochizuki, Yamanashi-ken (JP)

(72) Inventor: Hiroshi Mochizuki, Yamanashi-ken (JP)

(73) Assignee: NISCA CORPORATION, Minamikoma-Gun, Yamanashi-Ken (JP)

( * ) Notice: Subject to any disclaimer, the term of this patent is extended or adjusted under 35 U.S.C. 154(b) by 0 days.

(21) Appl. No.: 14/801,131

(22) Filed: Jul. 16, 2015

(30) Foreign Application Priority Data

Jul. 18, 2014 (JP) ..... 2014-147873

(51) Int. Cl.
*B41J 2/21* (2006.01)
*B41J 2/045* (2006.01)

(52) U.S. Cl.
CPC ..... *B41J 2/21* (2013.01); *B41J 2/04593* (2013.01)

(58) Field of Classification Search
CPC ..... B41J 2/01; B41J 2/2054; B41J 2/2132; B41J 2/2121; B41J 11/002; B41J 2/21; B41J 2/2114; B41J 2/04593; H04N 1/40087
See application file for complete search history.

(56) References Cited

U.S. PATENT DOCUMENTS 6,960,036 B1 * 11/2005 Fujita ..... B41J 2/2135 400/120.01
2014/0098151 A1 * 4/2014 Uchida ..... B41J 2/04505 347/12

FOREIGN PATENT DOCUMENTS

JP 2008-003396 A 1/2008
JP 2010-204547 A 9/2010

* cited by examiner

*Primary Examiner* — Thinh Nguyen
(74) *Attorney, Agent, or Firm* — Manabu Kanesaka

(57) ABSTRACT

To correct a color shift caused by printing data, a printing apparatus includes an image formation section that prints on a transfer film using color inks according to printing data, and a control section which stores or generates pattern data of a pattern having respective colors of the inks, and combines the printing data and the pattern data so that a printing image of the pattern data overlaps a part of a printing image of the printing data. The control section corrects a printing start position on the transfer film with the image formation section of at least one color ink among printing images to print respectively with the color inks, according to input first information concerning a shift in respective colors of the inks constituting the pattern occurring in forming an image on the transfer film in the image formation section according to combined printing data subjected to combining.

8 Claims, 16 Drawing Sheets

PRINTING APPARATUS

TECHNICAL FIELD

The present invention relates to a printing apparatus, and more particularly, to a printing apparatus provided with a printing section that performs printing on media using a plurality of color inks according to printing data.

BACKGROUND ART

Conventionally, such a printing apparatus has been known widely that forms an image on a transfer medium such as an image carrying body or a printing medium such as a card and sheet. For example, this type of printing apparatus uses an indirect printing scheme for forming an image (mirror image) on a transfer medium using an ink ribbon, and next transferring the image formed on the transfer medium to a printing medium, or a direct printing scheme for forming an image directly on a printing medium using an ink ribbon.

In such a printing apparatus, generally, color printing for generating a color image is performed by superimposing respective printing images with a plurality of color inks. In other words, color printing is performed by superimposing a printing image for each of a plurality of color inks (for example, inks of YMC) on a medium (transfer medium in the indirect printing scheme, printing medium in the direct printing scheme), according to input printing data or printing data (for example, printing data for each of Y (Yellow), M (Magenta) and C (Cyan)) obtained by converting input image data.

In color printing, when printing positions of respective printing images of color inks on the medium are shifted, since the color image printed on the medium is blurred, the printing quality (image quality) degrades. In addition, the phenomenon that the printing position of the printing image of each color is shifted is generally called the "color shift". Therefore, techniques are disclosed to correct the printing position of the printing image of each color. For example, proposed are techniques for printing a concentration correction pattern and color shift correction pattern on an intermediate transfer belt to reduce the correction time (see Patent Document 1) and techniques for using an unused region that is not used in image printing inside an image formation-capable region to make a register adjustment (see Patent Document 2).

PRIOR ART DOCUMENT

Patent Document

[Patent Document 1] Japanese Patent Application Publication No. 2008-3396

[Patent Document 2] Japanese Patent Application Publication No. 2010-204547

DISCLOSURE OF INVENTION

Problems to be Solved by the Invention

In addition, there is a phenomenon in which an expansion/contraction extent in the transport direction (printing sub-scanning direction of a printing section) of a medium affects depending on properties (concentration, area, etc.) of a printing image and a shift (color shift) of the printing position occurs by a difference in the expansion/contraction extent between respective printing images of color inks. Typically, for example, a part of one of YMC printing images or all of the printing images is printed with high gradation ink (concentration is high), and as the area of the portion provided with high gradation is larger, the color shift tends to occur. Such a color shift phenomenon appears more remarkably in the indirect printing scheme for forming a printing image of each color on a transfer medium (for example, transfer film) with low specific heat. For this phenomenon, the techniques proposed in Patent Documents 1 and 2 are not to superimpose the correction pattern on the printing image to print, and do not propose a section for correcting the color shift caused by properties (properties of printing data) of printing images as described above.

In view of the aforementioned matter, it is an object of the present invention to provide a printing apparatus capable of correcting a color shift caused by properties of printing data.

Means for Solving the Problem

In order to attain the above-mentioned object, the present invention is of a printing apparatus provided with a printing section that prints on a medium using a plurality of color inks according to printing data, a storage/generation section that stores or generates pattern data of a pattern comprised of respective colors of the inks, a combining section that combines the printing data and the pattern data so that a printing image of the pattern data stored or generated in the storage/generation section overlaps a part of a printing image of the printing data, and a correction section that corrects a printing start position on the medium with the printing section of the printing image of at least one color ink among printing images to print respectively with the plurality of color inks, according to input first information that is information concerning a shift in respective colors of the inks constituting the pattern occurring in printing on the medium with the printing section according to combined printing data combined in the combining section.

In the present invention, the pattern data of the pattern comprised of respective colors of a plurality of color inks is stored or generated in the storage/generation section, and the printing data and pattern data is combined in the combining section so that the printing image of the pattern data stored or generated in the storage/generation section overlaps a part of the printing image of the printing data. Next, in order to check an extent of the color shift, the printing section performs printing on the medium using a plurality of color inks according to the combined printing data combined in the combining section. In such printing with the combined printing data, a shift occurs in respective colors of the inks constituting the pattern caused by properties of the printing data. The operator inputs the information concerning the shift in the colors as the first information. Then, the printing section prints on the medium according to the printing data, and at this point, in order to correct the color shift caused by properties of the printing data, according to the first information, the correction section corrects a printing start position on the medium with the printing section of the printing image of at least one color ink among printing images to print respectively with the plurality of color inks.

In the present invention, the combining section may combine the printing data and the pattern data so that a plurality of printing images of the pattern data stored or generated in the storage/generation section is disposed apart from one another in the printing sub-scanning direction of the printing section. Further, the combining section may combine the printing data and the pattern data so that a portion of the printing image of the printing data overlapping the printing image of the pattern data is invisible. Furthermore, the pattern may be disposed so that respective colors of the inks are placed in a line in the printing main scanning direction of the printing section.

Further, the storage/generation section may generate the pattern data according to input second information including at least one piece of information of information to identify the pattern, information concerning a size of the printing image of the pattern data and information concerning a gradation of the inks constituting the pattern. Furthermore, the combining section may combine the printing data and the pattern data according to input third information including at least one piece of information of information concerning the number of printing images of the pattern data and information concerning a position of the printing image of the pattern data on the printing medium.

Furthermore, the correction section may calculate a correction amount of the printing start position on the medium of the printing image of at least one color ink so as to decrease a shift amount in respective colors of the inks constituting the pattern in the printing sub-scanning direction of the printing section. Still furthermore, the first information may be a shift amount in the printing sub-scanning direction of the printing section of the other color ink with respect to one color ink among the inks constituting the pattern.

Advantageous Effect of the Invention

According to the present invention, in printing on the medium with the printing section according to the printing data, the correction section corrects a printing start position on the medium with the printing section of the printing image of at least one color ink among printing images to print respectively with a plurality of color inks according to the first information, and therefore, it is possible to obtain the effect of enabling the color shift caused by properties of the printing data to be corrected.

BEST MODE FOR CARRYING OUT THE INVENTION

Referring to drawings, described below is an Embodiment in which the present invention is applied to a printing apparatus for printing and recording text and image on a card, while performing magnetic or electric information recording on the card.

<System Configuration>

Figure 1:
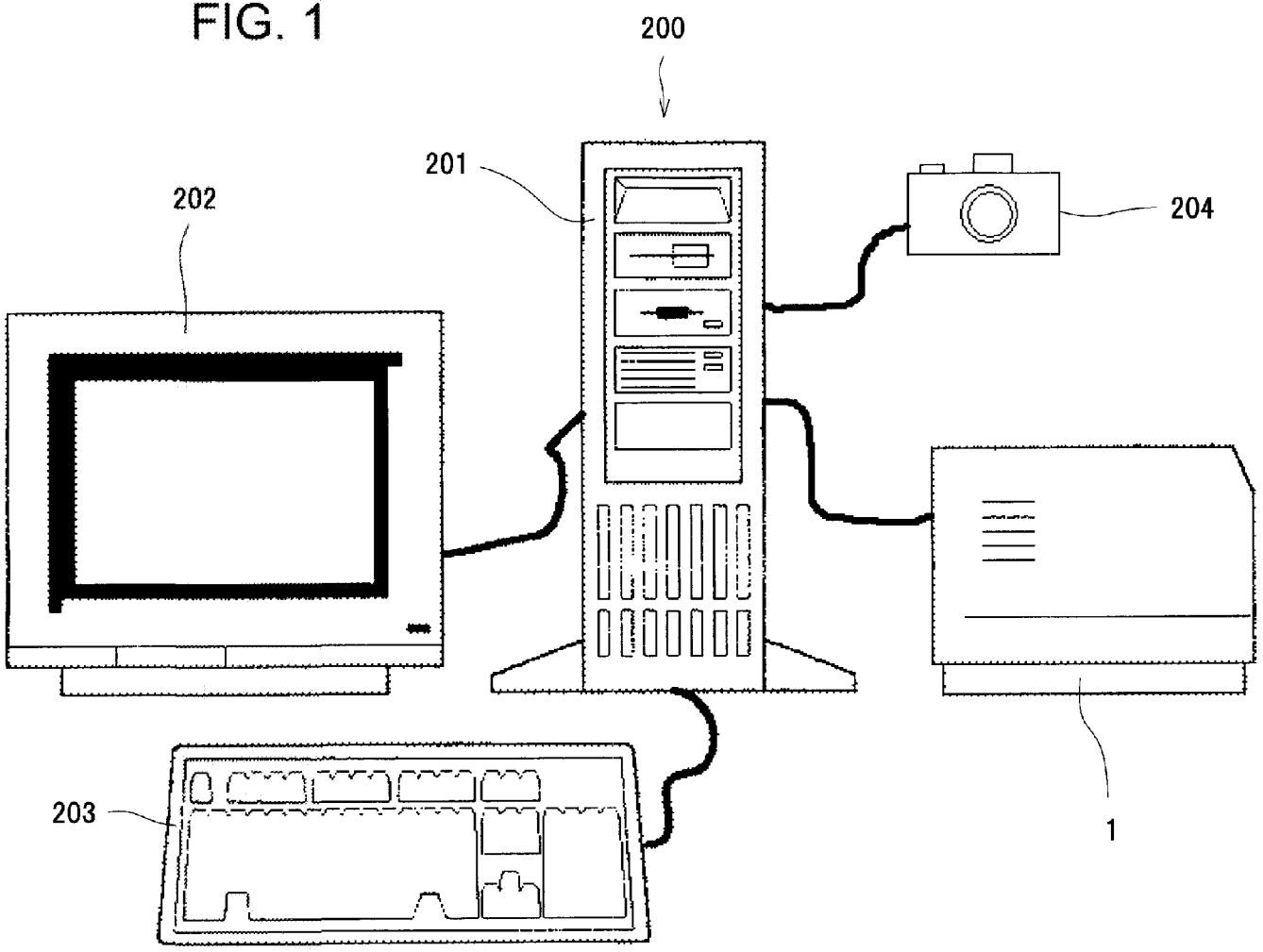
FIG. 1 is an external view of a printing system including a printing apparatus of an Embodiment to which the present invention is applicable.
Figure 12:
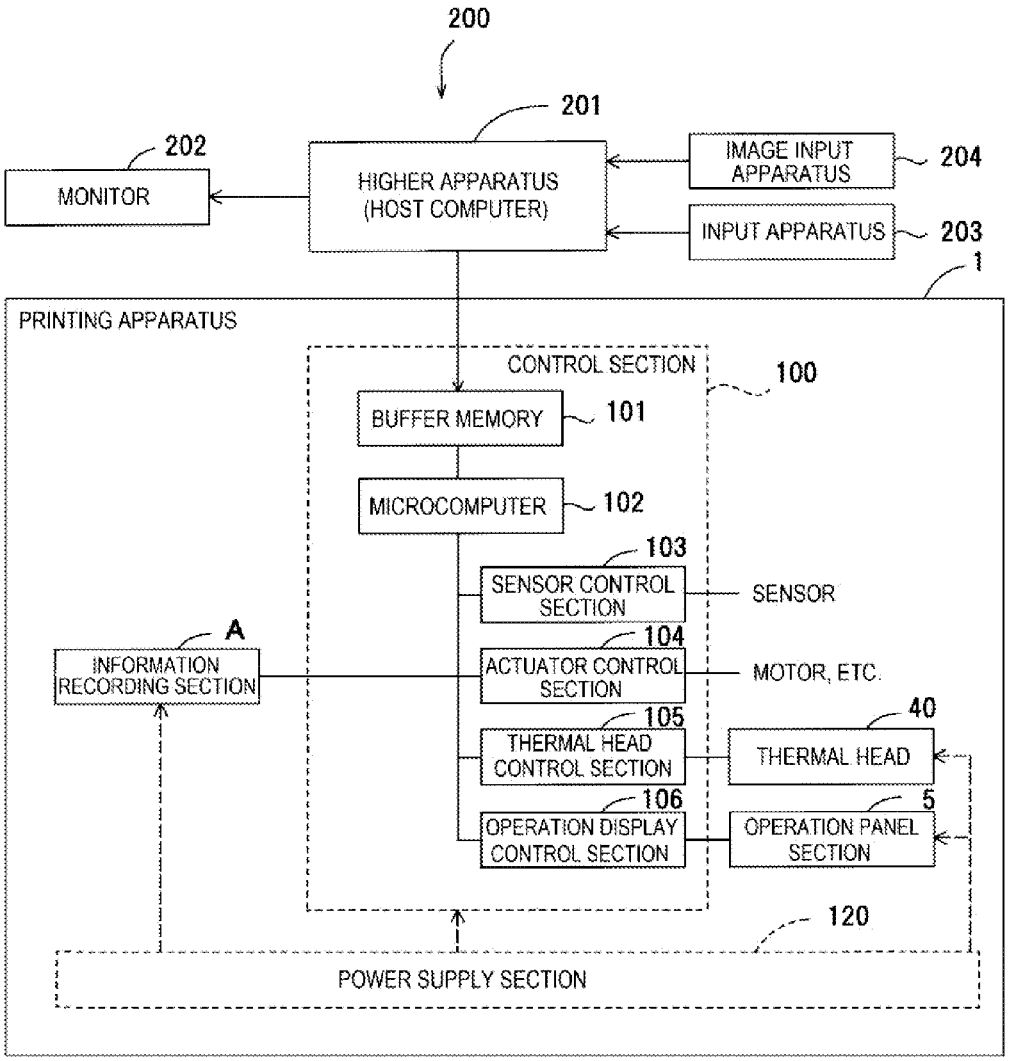
FIG. 12 is a block diagram illustrating a schematic configuration of a control section in the printing apparatus of the Embodiment.

As shown in FIGS. 1 and 12, a printing apparatus 1 of this Embodiment constitutes apart of a printing system 200. In other words, the printing system 200 is broadly comprised of a higher apparatus 201 (for example, host computer such as a personal computer), and the printing apparatus 1.

The printing apparatus 1 is connected to the higher apparatus 201 via an interface with the figure omitted, and the higher apparatus 201 is capable of transmitting printing data (or image data), magnetic or electric recording data and the like to the printing apparatus 1 to indicate recording operation and the like. In addition, the printing apparatus 1 has an operation panel section (operation display section) 5 (see FIG. 12), and as well as recording operation indication from the higher apparatus 201, recording operation is also capable of being indicated from the operation panel section 5.

The higher apparatus 201 is connected to an image input apparatus 204 such as a digital camera and scanner, an input apparatus 203 such as a keyboard and mouse to input commands and data to the higher apparatus 201, and a monitor 202 such as a liquid crystal display to display data and the like generated in the higher apparatus 201.

<Printing Apparatus>

Figure 2:
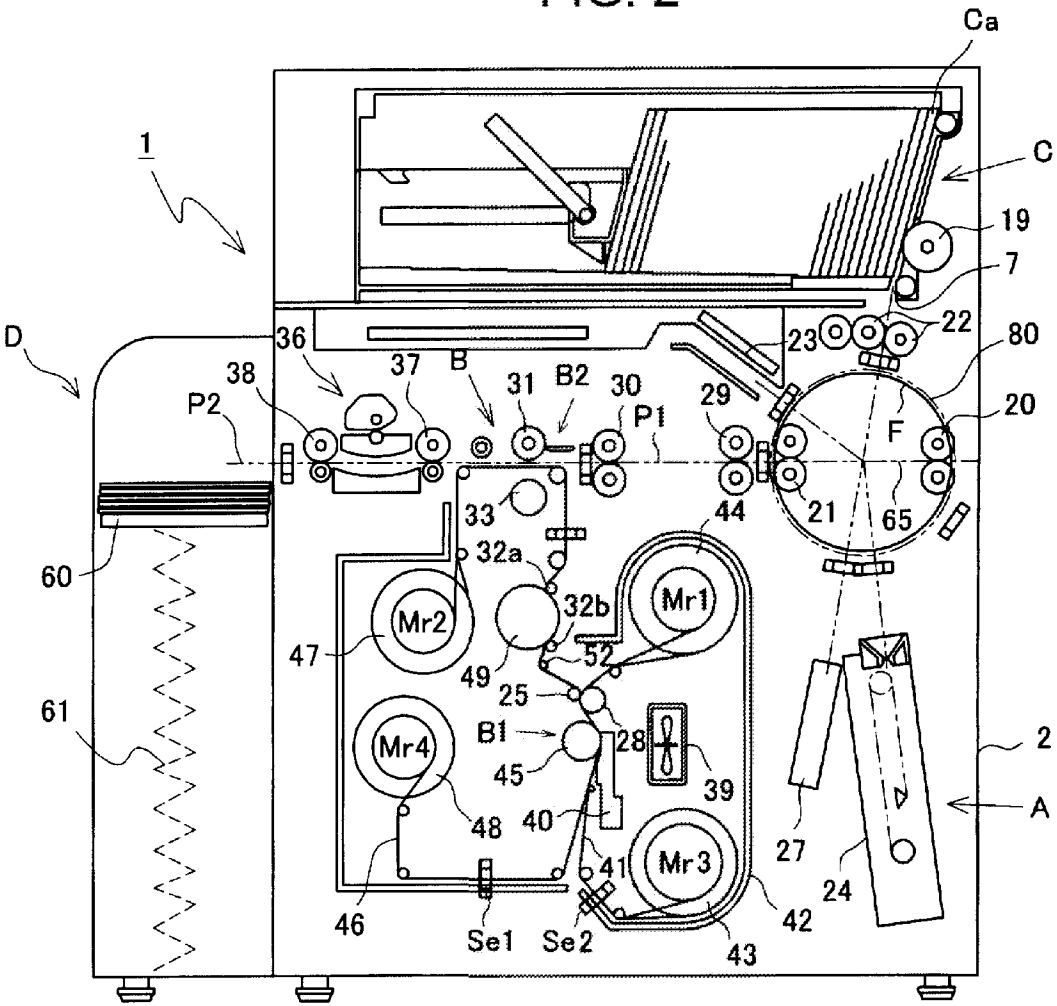
FIG. 2 is a schematic configuration view of the printing apparatus of the Embodiment.

As shown in FIG. 2, the printing apparatus 1 has a housing 2, and in the housing 2 are provided an information recording section A, printing section B, media storage section C, storage section D and rotating unit F.

(Information Recording Section)

The information recording section A is comprised of a magnetic recording section 24, non-contact type IC recording section 23, and contact type IC recording section 27.

(Media Storage Section)

The media storage section C aligns a plurality of cards in a standing posture to store, is provided at its front end with a separation opening 7, feeds and supplies sequentially starting with the card in the front row with a pickup roller 19.

(Rotating Unit)

The fed blank card Ca is sent to a reverse unit F with carry-in rollers 22. The reverse unit F is comprised of a rotating frame 80 bearing-supported by the housing 2 to be turnable, and two roller pairs 20, 21 supported on the frame. Then, the roller pairs 20, 21 are axially supported by the rotating frame 80 to be rotatable.

In the outer region of the rotating reverse unit F are disposed the above-mentioned magnetic recording section 24, non-contact type IC recording section 23, and contact type IC recording section 27. Then, the roller pairs 20, 21 form a medium transport path 65 for transporting the card Ca toward one of the information recording sections 23, 24 and 27, and data is magnetically or electrically written on the card Ca in the recording sections.

(Printing Section)

The printing section B is to form an image such as a photograph of face and text data on the frontside and backside of the card Ca, and a medium transport path P1 for carrying the card Ca is provided on an extension of the medium transport path 65. Further, in the medium transport path P1 are disposed transport rollers 29, 30 that transport the card Ca, and the rollers are coupled to a transport motor not shown.

The printing section B has a film-shaped medium transport mechanism, and is provided with an image formation section B1 that forms an image, with a thermal head 40, on a transfer film 46 transported with the transport mechanism, and a transfer section B2 that subsequently transfers the image formed on the transfer film 46 to the surface of the card Ca on the medium transport path P1 with a heat roller 33.

On the downstream side of the printing section B is provided a medium transport path P2 for carrying the printed card Ca to a storage stacker 60. In the medium transport path P2 are disposed transport rollers 37, 38 that transport the card Ca, and the rollers are coupled to a transport motor not shown.

A decurl mechanism 36 is disposed in between the transport roller 37 and the transport roller 38, presses the card center portion held between the transport rollers 37, 38, and thereby corrects a curl generated by thermal transfer with the heat roller 33. Therefore, the decurl mechanism 36 is configured to be able to shift to positions in the vertical direction as viewed in FIG. 2 by an up-and-down mechanism including a cam not shown.

(Storage Section)

The storage section D is configured to store cards Ca sent from the printing section B in the storage stacker 60. The storage stacker 60 is configured to shift downward in FIG. 2 with an up-and-down mechanism 61.

(Details of the Printing Section)

Next, the printing section B of the printing apparatus 1 as described above will be further described specifically.

The transfer film 46 has the shape of a band having a width slightly larger than the width direction of the card Ca, and is formed by layering, from above, an ink reception layer that receives ink of an ink ribbon 41, a transparent protective layer that protects the surface of the ink reception layer, a peeling layer to promote integral peeling of the ink reception layer and protective layer by heat, and a substrate (base film) in this order.

The transfer film 46 is wound up or fed by a wind-up roll or feed roll that rotates inside a transfer film cassette by driving of motor Mr2 or Mr4, respectively. In other words, in the transfer film cassette, a wind-up spool 47 is disposed in the center of the wind-up roll, a supply spool 48 is disposed in the center of the feed roll, a rotation drive force of the motor Mr2 is transferred to the wind-up spool 47 via a gear not shown, and a rotation derive force of the motor Mr4 is transferred to the supply spool 48 via a gear not shown.

A film transport roller 49 is a main drive roller to carry the transfer film 46, and by controlling driving of the roller 49, transport amount and transport halt position of the transfer film 46 are determined. The film transport roller 49 is coupled to a stepping motor not shown. Accordingly, by monitoring the number of pulses output to the stepping motor not shown, controlled are a printing start position in the transfer film 46 with the thermal head 40 in the image formation section B1, and a transfer position of the transfer film 46 to the card Ca in the transfer section B2. In addition, the motors Mr2 and Mr4 are driven also in driving the film transport roller 49, are to wind up the transfer film 46 fed from one of the wind-up spool 47 and supply spool 48 with the other one, and are not driven as main transport of the transfer film 46. In addition, forward-backward rotatable DC motors are used for the motors Mr2 and Mr4.

Pinch rollers 32*a* and 32*b* are disposed on the periphery of the film transport roller 49. Although not shown in FIG. 2, the pinch rollers 32*a* and 32*b* are configured to be movable to move and retract with respect to the film transport roller 49, and in a state in the figure, the rollers move to the film transport roller 49 to come into press-contact, and thereby wind the transfer film 46 around the film transport roller 49. By this means, the transfer film 46 undergoes accurate transport by a distance corresponding to the number of revolutions of the film transport roller 49.

The ink ribbon 41 is stored in an ink ribbon cassette 42 in a state in which the ribbon is laid between a supply spool 43 for supplying the ink ribbon 41 and a wind-up spool 44 for winding up the ink ribbon 41, the wind-up spool 44 rotates by a drive force of a motor Mr1, and the supply spool 43 rotates by a drive force of a motor Mr3. Forward-backward rotatable DC motors are used for the motors Mr1 and Mr3.

The ink ribbon 41 is configured by repeating color ribbon panels of Y (Yellow), M (Magenta), and C (Cyan) and a Bk (Black) ribbon panel in the longitudinal direction in a face sequential manner. Further, an empty mark indicative of a use limit of the ink ribbon 41 is attached to an end portion of the ink ribbon 41. "Se2" shown in FIG. 2 denotes a transmission sensor to detect the empty mark.

A platen roller 45 and thermal head 40 form the image formation section B1, and the thermal head 40 is disposed in a position opposed to the platen roller 45. The thermal head 40 has a plurality of heating elements lined in the main scanning direction, these heating elements are selectively heated and controlled by a head control IC (not shown) according to printing data, and an image is printed on the transfer film 46 via the ink ribbon 41. In addition, a cooling fan 39 is to cool the thermal head 40.

The ink ribbon 41 with which printing on the transfer film 46 is finished is peeled off from the transfer film 46 with a peeling roller 25 and peeling member 28. The peeling member 28 is fixed to the ink ribbon cassette 42, the peeling roller 25 comes into contact with the peeling member 28 in printing, and the roller 25 and member 28 nip the transfer film. 46 and ink ribbon 41 to peel. Then, the peeled ink ribbon 41 is wound around the wind-up spool 44 by the drive force of the motor Mr1, and the transfer film 46 is transported to the transfer section B2 having the platen roller 31 and heat roller 33 by the film transport roller 49.

In the transfer section B2, the transfer film 46 is nipped together with the card Ca by the heat roller 33 and platen roller 31, and the image on the transfer film 46 is transferred to the card surface. In addition, the heat roller 33 is attached to an up-and-down mechanism (not shown) so as to come into contact with and separate from the platen roller 31 via the transfer film 46.

Figure 3:
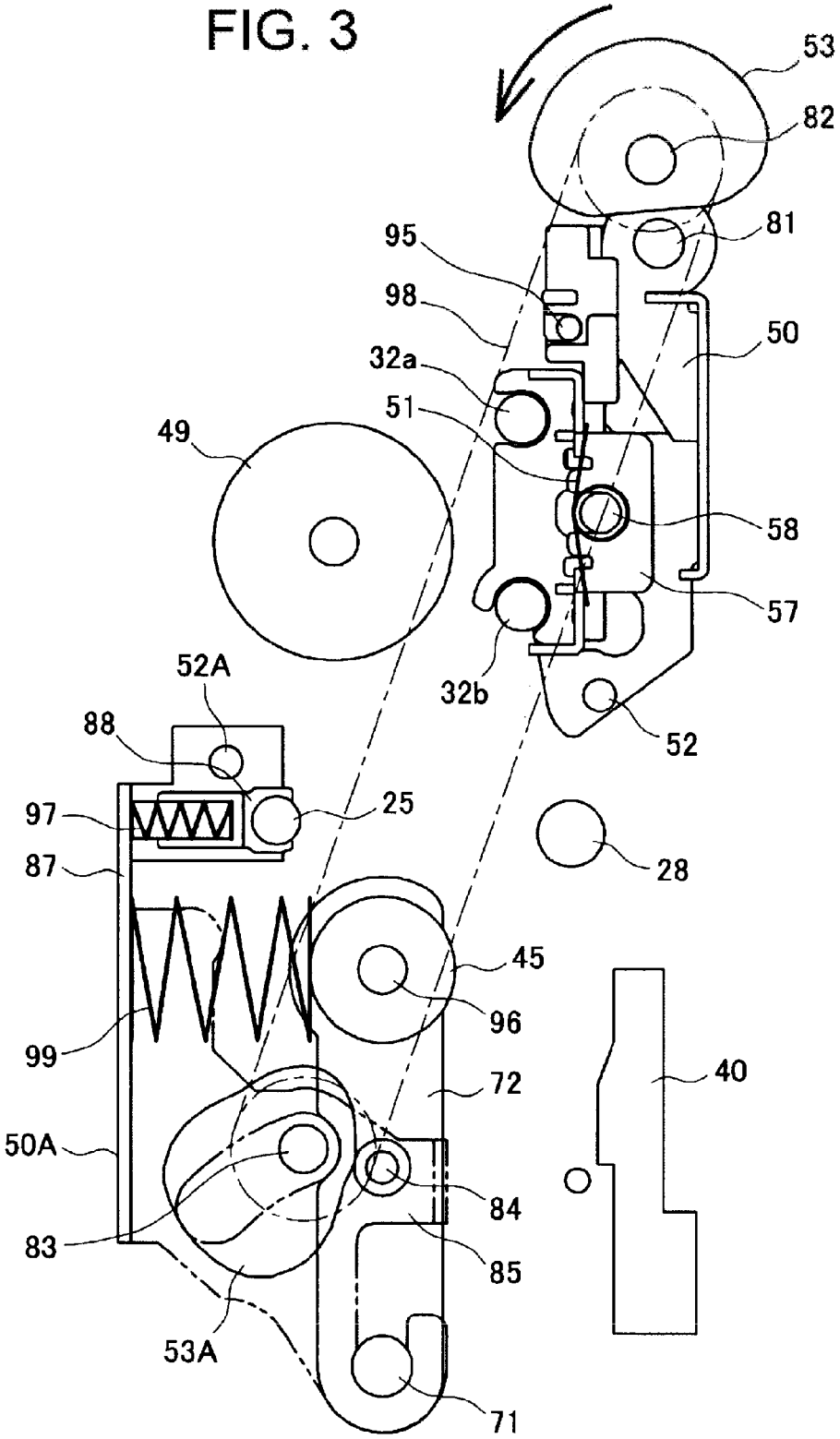
FIG. 3 is an explanatory view of a control state by a cam in a waiting position in which pinch rollers and film transport roller are separated from each other, and a platen roller and thermal head are separated from each other.
Figure 4:
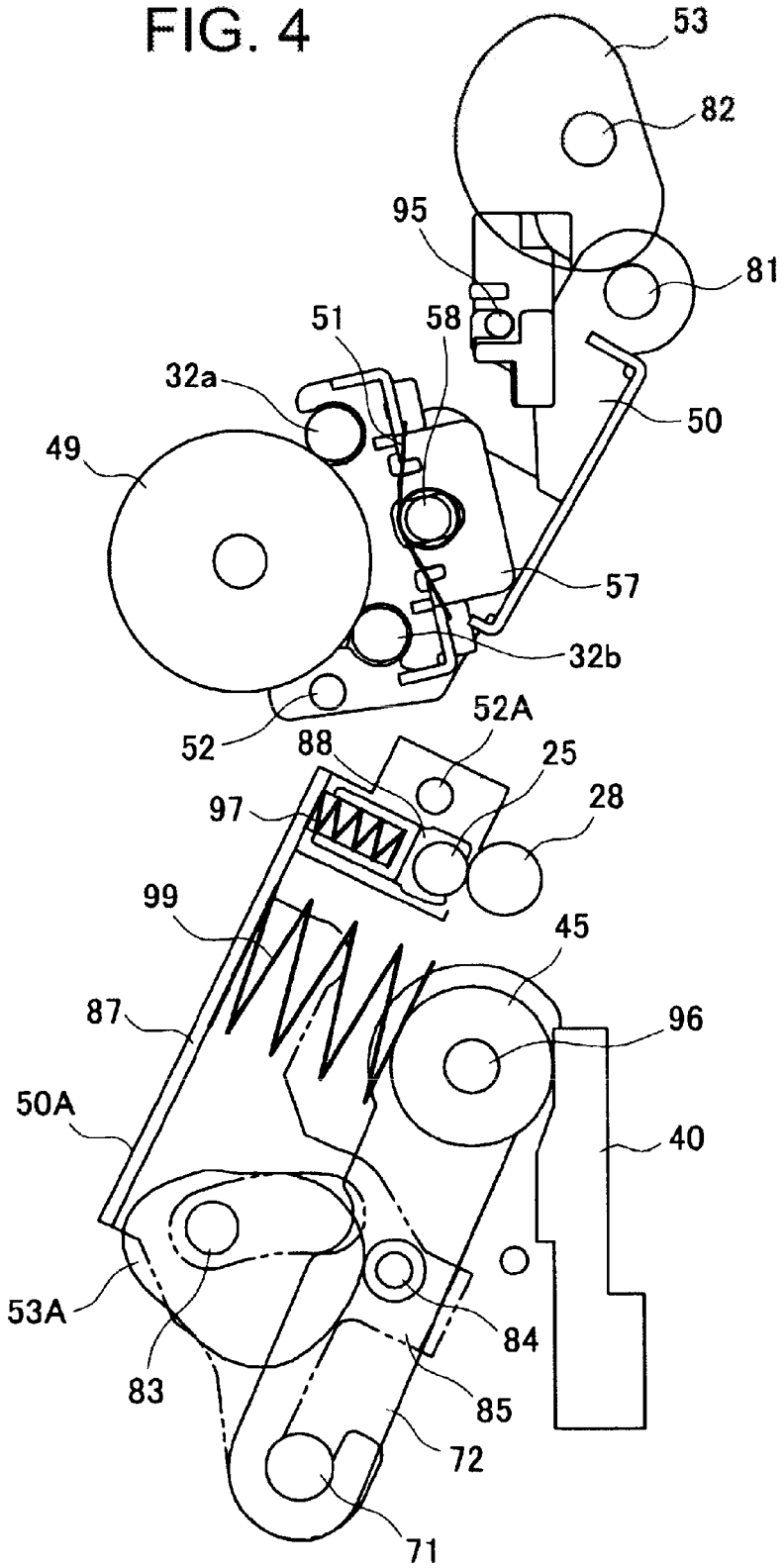
FIG. 4 is an explanatory view of a control state by the cam in a printing position in which the pinch rollers and film transport roller are brought into contact with each other, and the platen roller and thermal head are brought into contact with each other.
Figure 5:
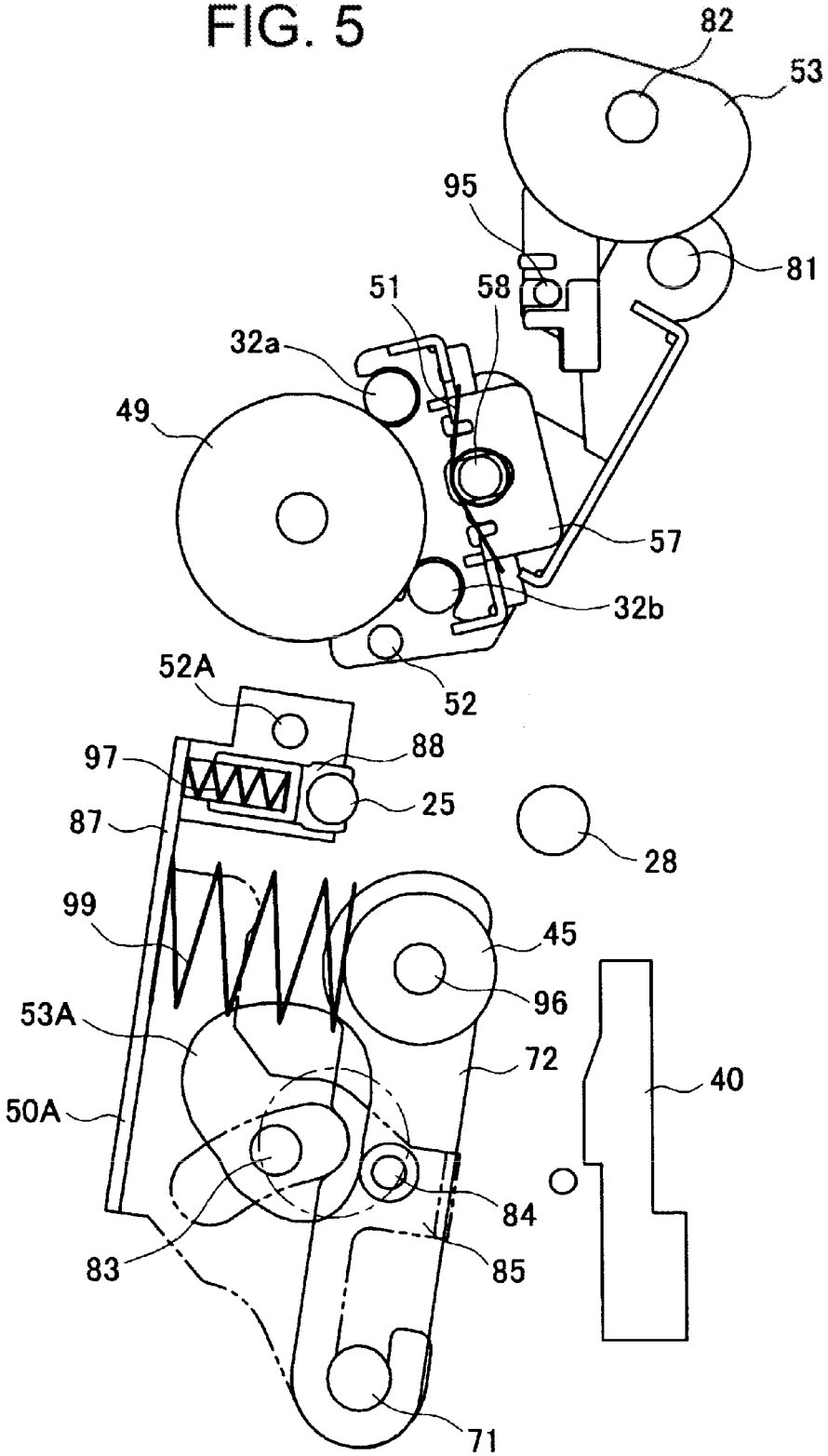
FIG. 5 is an explanatory view of a control state by the cam in a transport position in which the pinch rollers and film transport roller are brought into contact with each other, and the platen roller and thermal head are brought into contact with each other.
Figure 10:
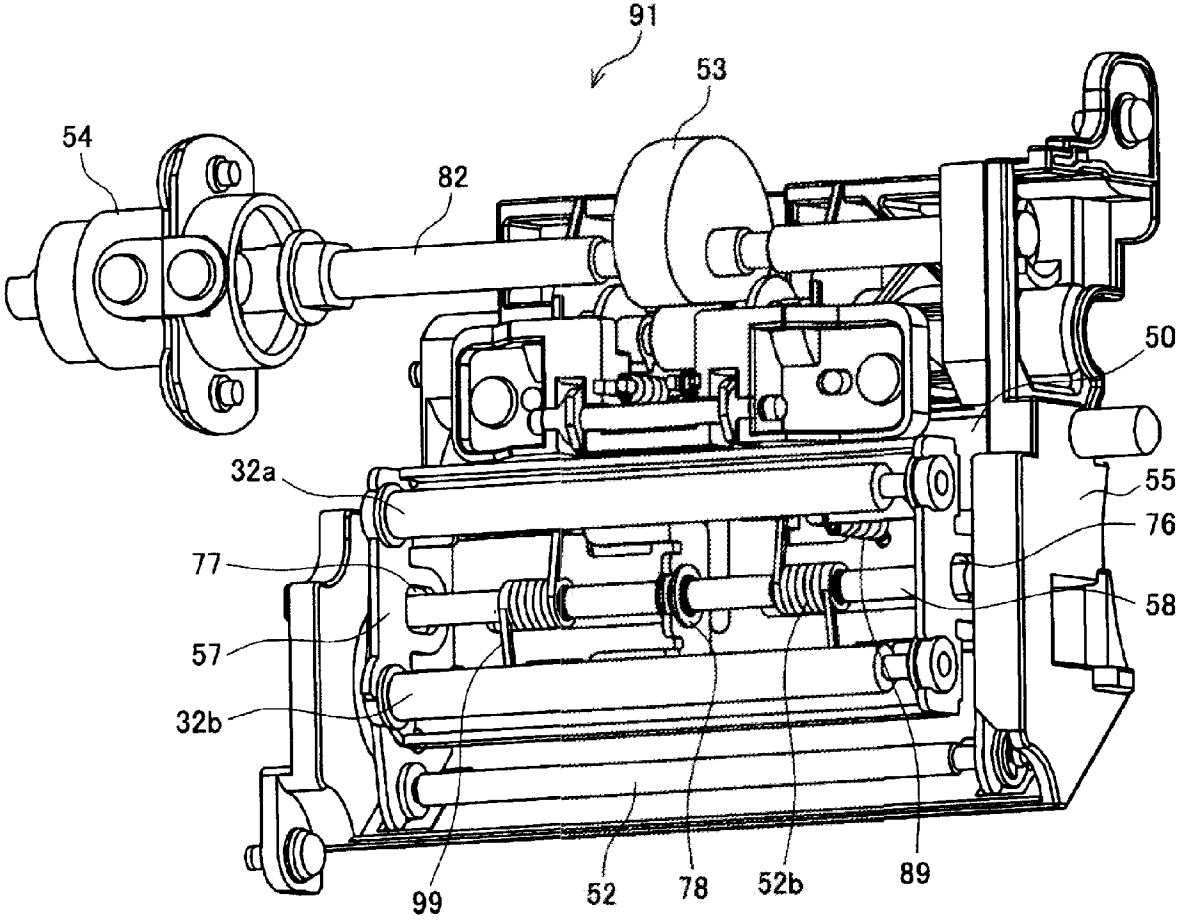
FIG. 10 is an external view showing a configuration of a second unit integrated to incorporate the pinch rollers and their peripheral parts into the printing apparatus.

The configuration of the image formation section B1 will specifically be described further together with its action. As shown in FIGS. 3 to 5, the pinch rollers 32*a*, 32*b* are respectively supported by an upper end portion and lower end portion of a pinch roller support member 57, and the pinch roller support member 57 is supported rotatably by a support shaft 58 penetrating the center portion of the member 57. As shown in FIG. 10, the support shaft 58 is laid at its opposite end portions between long holes 76, 77 formed in the pinch roller support member 57, and is at its center portion fixed to a fix portion 78 of a bracket 50. Further, the long holes 76, 77 are provided with spaces in the horizontal direction and vertical direction with respect to the support shaft 58. By this means, it is made possible to adjust the pinch rollers 32*a*, 32*b* with respect to the film transport roller 49, described later.

Spring members 51 (51*a*, 51*b*) are mounted on the support shaft 58, and end portions on which the pinch rollers 32*a*, 32*b* are installed of the pinch roller support member 57 respectively contact the spring members 51, and are biased to the direction of the film transport roller 49 by the spring forces.

The bracket 50 comes into contact with the cam operation surface of a cam 53 in a cam receiver 81, and is configured to shift in the horizontal direction viewed in the figure with respect to the film transport roller 49, corresponding to rotation in the arrow direction of the cam 53 with a cam shaft 82 as the axis rotating by drive force of a drive motor 54 (see FIG. 10). Accordingly, when the bracket 50 moves toward the film transport roller 49 (FIGS. 4 and 5), the pinch rollers 32*a*, 32*b* come into press-contact with the film transport roller 49 against the spring members 51 with the transfer film 46 nipped, and wind the transfer film 46 around the film transport roller 49.

At this point, the pinch roller 32*b* in a farther position from a shaft 95 as a rotation axis of the bracket 50 first comes into press-contact with the film transport roller 49, and next, the pinch roller 32*a* comes into press-contact. In this way, by arranging the shaft 95 that is the rotation axis higher than the film transport roller 49, the pinch roller support member 57 comes into contact with the film transport roller 49 while rotating, instead of parallel shift, and there is the advantage that the space in the width direction is less than in the parallel shift.

Further, the press-contact forces when the pinch rollers 32*a*, 32*b* come into press-contact with the film transport roller 49 are uniform in the width direction of the transfer film 46 by the spring members 51. At this point, since the long holes 76, 77 are formed on the opposite sides of the pinch roller support member 57 and the support shaft 58 is fixed to the fix portion 78, it is possible to adjust the pinch roller support member 57 in three directions, and the transfer film 46 is transported in a correct posture by rotation of the film transport roller 49 without causing skew. In addition, adjustments in three directions described herein are to (i) adjust the parallel degree in the horizontal direction of the shafts of the pinch rollers 32*a*, 32*b* with respect to the shaft of the film transport roller 49 to uniform the press-contact forces in the shaft direction of the pinch rollers 32*a*, 32*b* with respect to the film transport roller 49, (ii) adjust shift distances of the pinch rollers 32*a*, 32*b* with respect to the film transport roller 49 to uniform the press-contact force of the pinch roller 32*a* on the film transport roller 49 and the press-contact force of the pinch roller 32*b* on the film transport roller 49, and (iii) adjust the parallel degree in the vertical direction of the shafts of the pinch rollers 32*a*, 32*b* with respect to the shaft of the film transport roller 49 so that the shafts of the pinch rollers 32*a*, 32*b* are perpendicular to the film travel direction.

Furthermore, the bracket 50 is provided with a tension receiving member 52 that comes into contact with a portion of the transfer film 46 which is not wound around the film transport roller 49 when the bracket 50 moves toward the film transport roller 49.

The tension receiving member 52 is provided to prevent the pinch rollers 32*a*, 32*b* from retracting from the film transport roller 49 respectively against the biasing forces of the spring members 51 due to the tension of the transfer film 46 occurring when the pinch rollers 32*a*, 32*b* bring the transfer film 46 into press-contact with the film transport roller 49. Accordingly, the tension receiving member 52 is attached to the front end of the end portion on the rotation side of the bracket 50 so as to come into contact with the transfer film 46 in the position to the left of the pinch rollers 32*a*, 32*b* viewed in the figure. FIG. 2 shows a state in which the tension receiving member 52 is brought into contact with the transfer film 46.

By this means, the cam 53 is capable of directly receiving the tension occurring due to elasticity of the transfer film 46 through the tension receiving member 52. Accordingly, the pinch rollers 32*a*, 32*b* are prevented from retracting from the film transport roller 49 due to the tension and from decreasing the press-contact forces of the pinch rollers 32*a*, 32*b*, thereby maintain the winding state in which the transfer film 46 is brought into intimate contact with the film transport roller 49, and are able to perform accurate transport.

Figure 9:
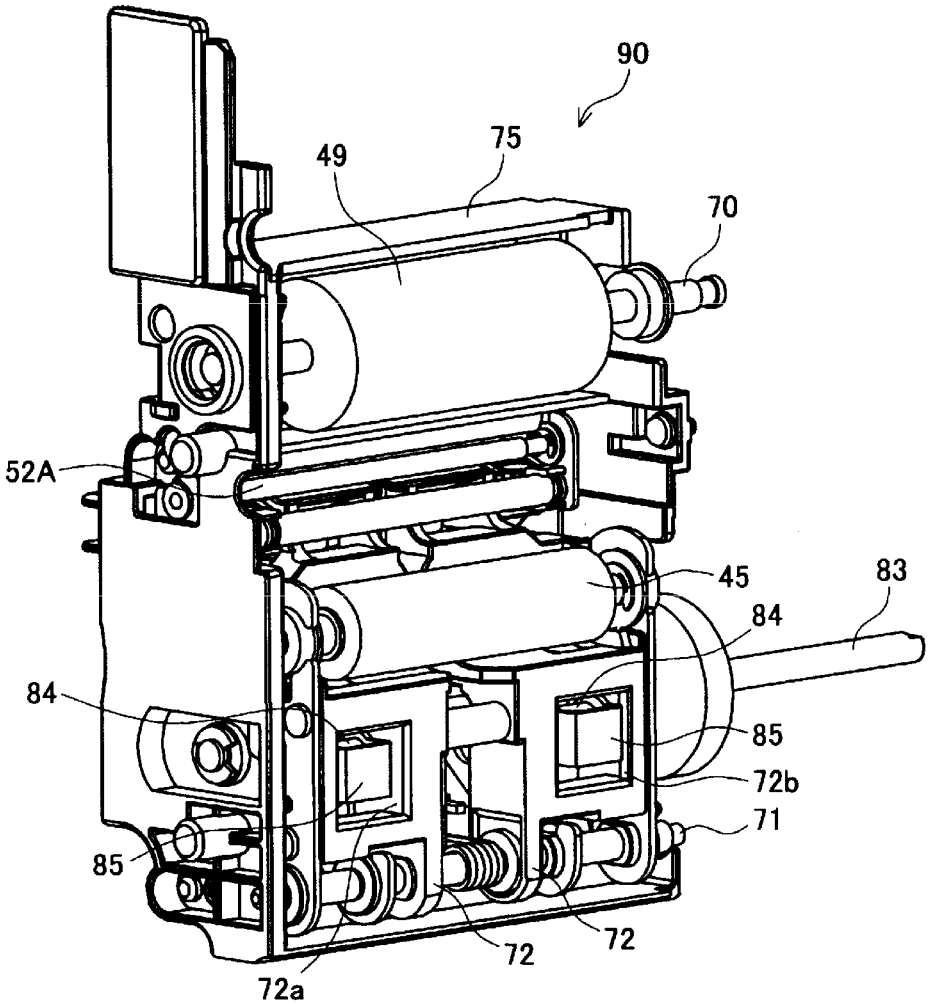
FIG. 9 is an external view showing a configuration of a first unit integrated to incorporate the film transport roller, platen roller and their peripheral parts into the printing apparatus.

As shown in FIG. 9, the platen roller 45 disposed along the transverse width direction of the transfer film 46 is supported by a pair of platen support members 72 rotatable on a shaft 71 as the axis. The pair of platen support members 72 support opposite ends of the platen roller 45. The platen support members 72 are respectively connected to end portions of a bracket 50A having the shaft 71 as a common rotating shaft via spring members 99.

The bracket 50A has a substrate 87, and cam receiver support portion 85 formed by bending the substrate 87 in the direction of the platen support member 72, and the cam receiver support portion 85 holds a cam receiver 84. A cam 53A rotating on a cam shaft 83 as the axis driven by the drive motor 54 is disposed between the substrate 87 and the cam receiver support portion 85, and is configured so that the cam operation surface and cam receiver 84 come into contact with each other. Accordingly, when the bracket 50A moves in the direction of the thermal head 40 by rotation of the cam 53A, the platen support members 72 also shift to bring the platen roller 45 into press-contact with the thermal head 40.

The spring members 99 and cam 53A are thus disposed vertically between the bracket 50A and platen support members 72, and it is thereby possible to store a platen shift unit within the distance between the bracket 50A and platen support members 72. Further, the width direction is held within the width of the platen roller 45, and it is possible to save space.

Moreover, since the cam receiver support portion 85 is fitted into bore portions 72*a*, 72*b* (see FIG. 9) formed in the platen support members 72, even when the cam receiver support portion 85 is formed while protruding in the direction of the platen support members 72, the distance between the bracket 50A and the platen support members 72 is not increased, and also in this respect, it is possible to save space.

When the platen roller 45 comes into press-contact with the thermal head 40, the spring members 99 connected to respective platen support members 72 act each so as to uniform the press-contact force on the width direction of the transfer film 46. Therefore, when the transfer film 46 is transported by the film transport roller 49, the skew is prevented, and it is possible to perform image formation on the transfer film 46 by the thermal head 40 accurately without the printing region of the transfer film 46 shifting in the width direction.

The substrate 87 of the bracket 50A is provided with a pair of peeling roller support members 88 for supporting opposite ends of the peeling roller 25 via spring members 97, and when the bracket 50A moves to the thermal head 40 by rotation of the cam 53A, the peeling roller 25 comes into contact with the peeling member 28 to peel off the transfer film 46 and ink ribbon 41 nipped between the roller and member. The peeling roller support members 88 are also provided respectively at opposite ends of the peeling roller 25 as in the platen support members 72, and are configured so as to uniform the press-contact force in the width direction on the peeling member 28.

A tension receiving member 52A is provided in an end portion on the side opposite to the end portion on the shaft support 59 side of the bracket 50A. The tension receiving member 52A is provided to absorb the tension of the transfer film 46 occurring in bringing the platen roller 45 and peeling roller 25 respectively into press-contact with the thermal head 40 and peeling member 28. The spring members 99 and 97 are provided so as to uniform the press-contact force on the width direction of the transfer film 46, and in order for the spring members 99 and 97 not to be inversely behind the tension of the transfer film 46 and decrease the press-contact force on the transfer film 46, the tension receiving member 52A receives the tension from the transfer film 46. In addition, since the tension receiving member 52A is also fixed to the bracket 50A as in the above-mentioned tension receiving member 52, the cam 53A receives the tension of the transfer film 46 via the bracket 50A, and is not behind the tension of the transfer film 46. By this means, the press-contact force of the thermal head 40 and platen roller 45 and the press-contact force of the peeling member 28 and peeling roller 25 are held, and it is thereby possible to perform excellent printing and peeling. Further, any error does not occur in the transport amount of the transfer film 46 in driving the film transport roller 49, the transfer film 46 corresponding to the length of the printing region is accurately transported to the thermal head 40, and it is possible to perform printing with accuracy.

The cam 53 and cam 53A are driven by same drive motor 54 with a belt 98 (see FIG. 3) laid therebetween.

Figure 6:
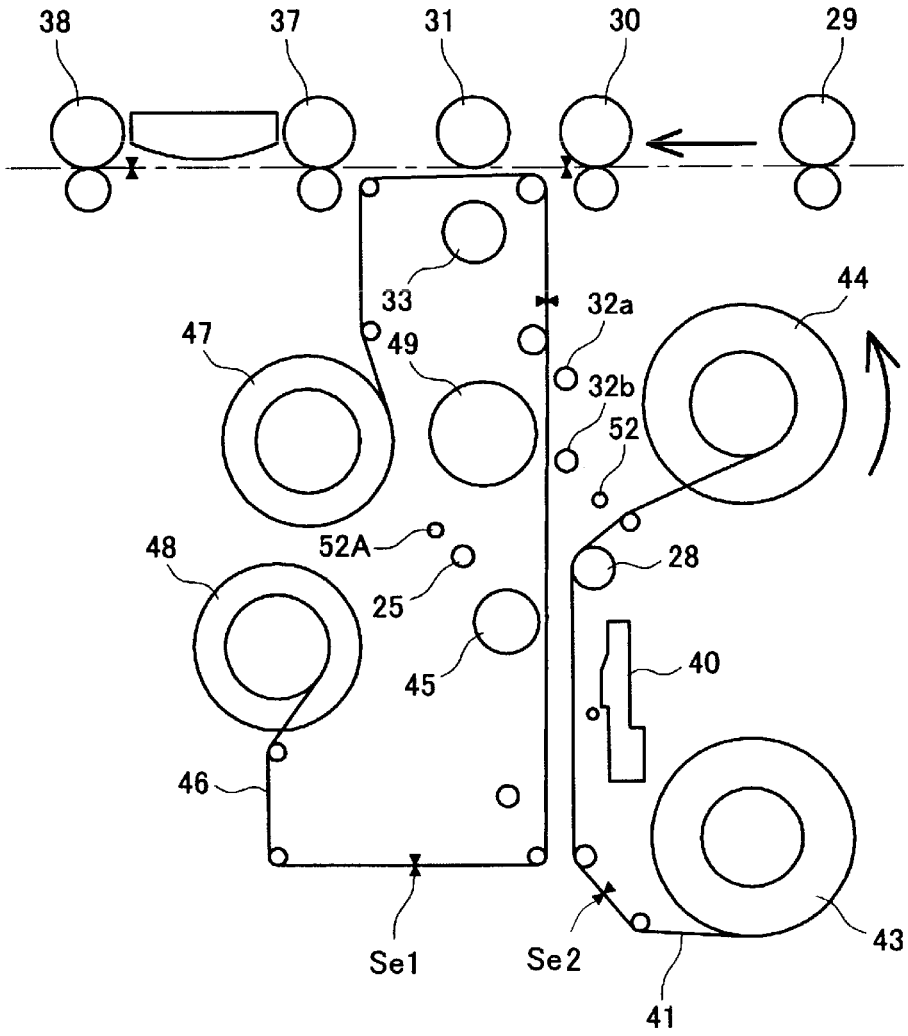
FIG. 6 is an operation explanatory view to explain the state of the waiting position in the printing apparatus.

When the printing section B is in a waiting position as shown in FIG. 6, the cam 53 and cam 53A are in the state as shown in FIG. 3, the pinch rollers 32*a*, 32*b* are not brought into press-contact with the film transport roller 49, and the platen roller 45 is not brought into press-contact with the thermal head 40 either. In other words, in the waiting position, the platen roller 45 and thermal head 40 are positioned in separate positions in which the roller 45 and head 40 are separate.

Figure 7:
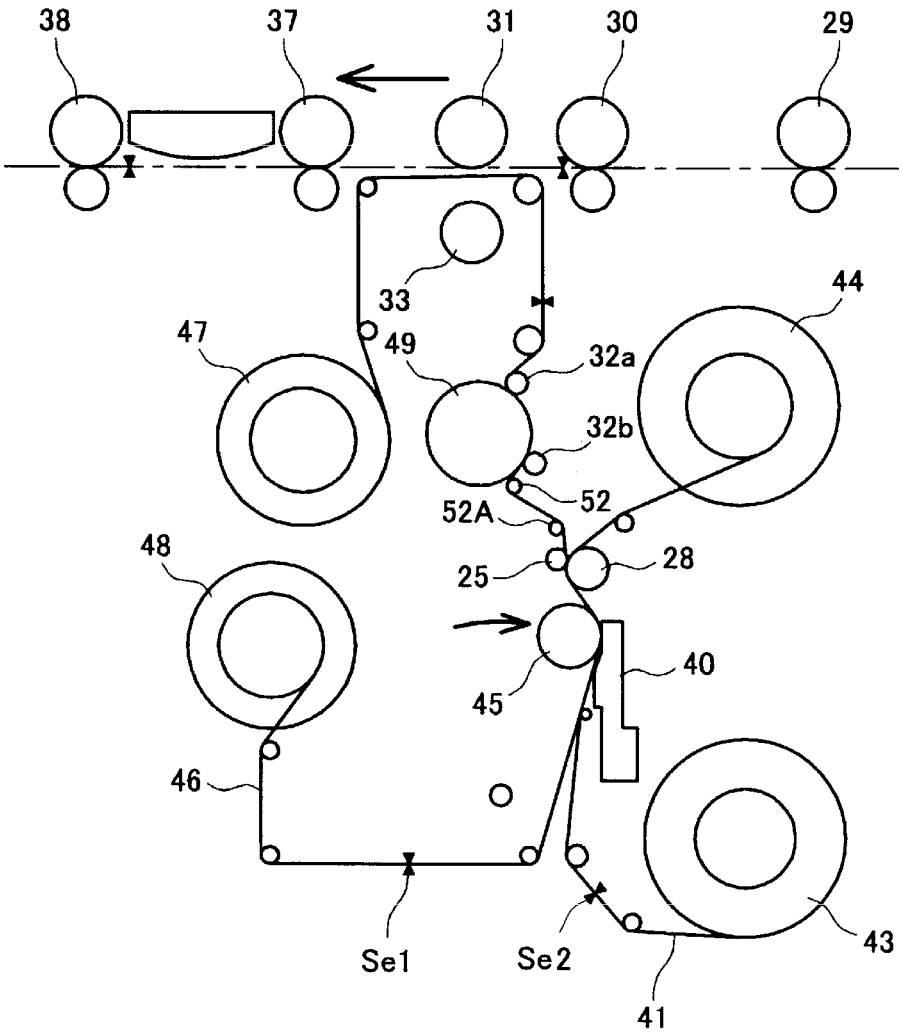
FIG. 7 is an operation explanatory view to explain the state of the transport position in the printing apparatus.

Then, when the cam 53 and cam 53A are rotated in conjunction with each other and are in the state as shown in FIG. 4, the printing section B shifts to a printing position as shown in FIG. 7. At this point, the pinch rollers 32*a*, 32*b* first wind the transfer film 46 around the film transport roller 49, and the tension receiving member 52 comes into contact with the transfer film 46. Subsequently, the platen roller 45 comes into press-contact with the thermal head 40. In this printing position, the platen roller 45 shifts toward the thermal head 40 to nip the transfer film 46 and ink ribbon 41 and come into press-contact, and the peeling roller 25 is in contact with the peeling member 28.

In this state, when transport of the transfer film 46 is started by rotation of the film transport roller 49, at the same time, the ink ribbon 41 is also wound around the wind-up spool 44 by operation of the motor Mn1 and transported in the same direction. During this transport, a positioning mark provided in the transfer film 46 passes through a sensor Se1 and shifts a predetermined amount, and at the time the transfer film 46 arrives at a printing start position, printing by the thermal head 40 is performed on the predetermined region of the transfer film 46. Particularly, since the tension of the transfer film 46 is large during printing, the tension of the transfer film 46 acts on the direction for separating the pinch rollers 32*a*, 32*b* from the film transport roller 49 and the direction for separating the peeling roller 25 and platen roller 45 from the peeling member 28 and thermal head 40. However, as described above, since the tension of the transfer film 46 is received in the tension receiving members 52, 52A, the press-contact forces of the pinch rollers 32*a*, 32*b* are not decreased, it is thereby possible to perform accurate film transport, the press-contact force of the thermal head 40 and platen roller 45 and the press-contract force of the peeling member 28 and peeling roller 25 are not decreased either, and it is thereby possible to perform accurate printing and peeling. The ink ribbon 41 with which printing is finished is peeled off from the transfer film 46 and wound around the wind-up spool 44.

A shift amount by transport of the transfer film 46 i.e. a length in the transport direction of a printing region to undergo printing is detected by an encoder (not shown) provided in the film transport roller 49, rotation of the film transport roller 49 is halted corresponding to detection, and at the same time, winding by the wind-up spool 44 by operation of the motor Mr1 is also halted. By this means, finished is printing with the ink of the first ink panel on the printing region of the transfer film 46.

Figure 8:
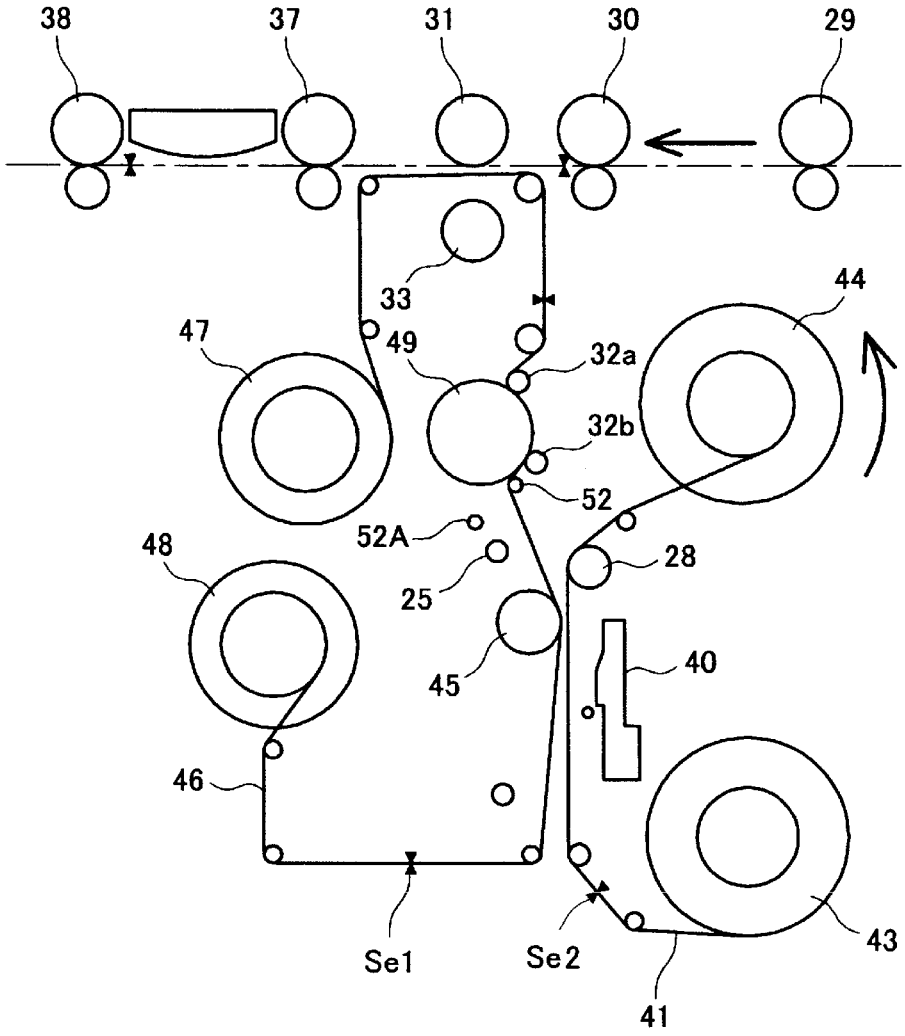
FIG. 8 is an operation explanatory view to explain the state of the printing position in the printing apparatus.

Next, when the cam 53 and cam 53A are further rotated in conjunction with each other and are in the state as shown in FIG. 5, the printing section B shifts to a transport position as shown in FIG. 8, and the platen roller 45 returns to the direction of retracting from the thermal head 40. In this state, the pinch rollers 32*a*, 32*b* still wind the transfer film 46 around the film transport roller 49, the tension receiving member 52 is in contact with the transfer film 46, and the transfer film 46 is transported backward to a beforehand determined printing preparation position by rotation in the backward direction of the film transport roller 49. Also at this point, the shift amount of the transfer film 46 is grasped with the rotation amount of the film transport roller 49, and the transfer film 46 is transported backward by a length slightly longer than the length in the transport direction of the printing region subjected to printing. In addition, the ink ribbon 41 is also rewound a predetermined amount with the motor Mr3, and the ink panel of the ink to print next waits in the initial position (feeding position).

Then, the control state by the cam 53 and cam 53A becomes the state as shown in FIG. 4 again and the printing position as shown in FIG. 7, the platen roller 45 is brought into press-contact with the thermal head 40, the film transport roller 49 rotates in the forward direction again to shift the transfer film 46 from the printing preparation position to the printing start position so as to perform positioning (feeding) with respect to the thermal head 40, and printing with the ink of the next ink panel is performed with the thermal head 40.

Thus, the operation in the printing position and transport position is repeated until printing with ink of all or predetermined ink panel is finished. Then, when printing with the thermal head 40 is finished, the image-formed region of the transfer film 46 is transported to the heat roller 33, and at this point, the cam 53 and cam 53A shift to the state as shown in FIG. 3, and release press-contact with the transfer film 46. Subsequently, transfer to the card Ca is performed while transporting the transfer film 46 by driving of the wind-up spool 47.

Such a printing section B is divided into three units 90, 91, and 92.

As shown in FIG. 9, in the first unit 90, a unit frame body 75 is installed with a drive shaft 70 that rotates by driving of the motor 54 (see FIG. 10), and the drive shaft 70 is inserted in the film transport roller 49. Below the film transfer roller 49 are disposed the bracket 50A and a pair of platen support members 72, and these members are supported rotatably by the shaft 71 laid between opposite side plates of the unit frame body 75.

In FIG. 9, a pair of cam receiver support portions 85 that are a part of the bracket 50A appear from the bore portions 72*a*, 72*b* formed in the platen support members 72. The cam receiver support portions 85 hold a pair of cam receivers 84 disposed at the back thereof. Then, at the back of the cam receivers 84 is disposed the cam 53A installed in the cam shaft 83 inserted in the unit frame body 75. The cam shaft 83 is laid between opposite side plates of the unit frame body 75.

Figure 11:
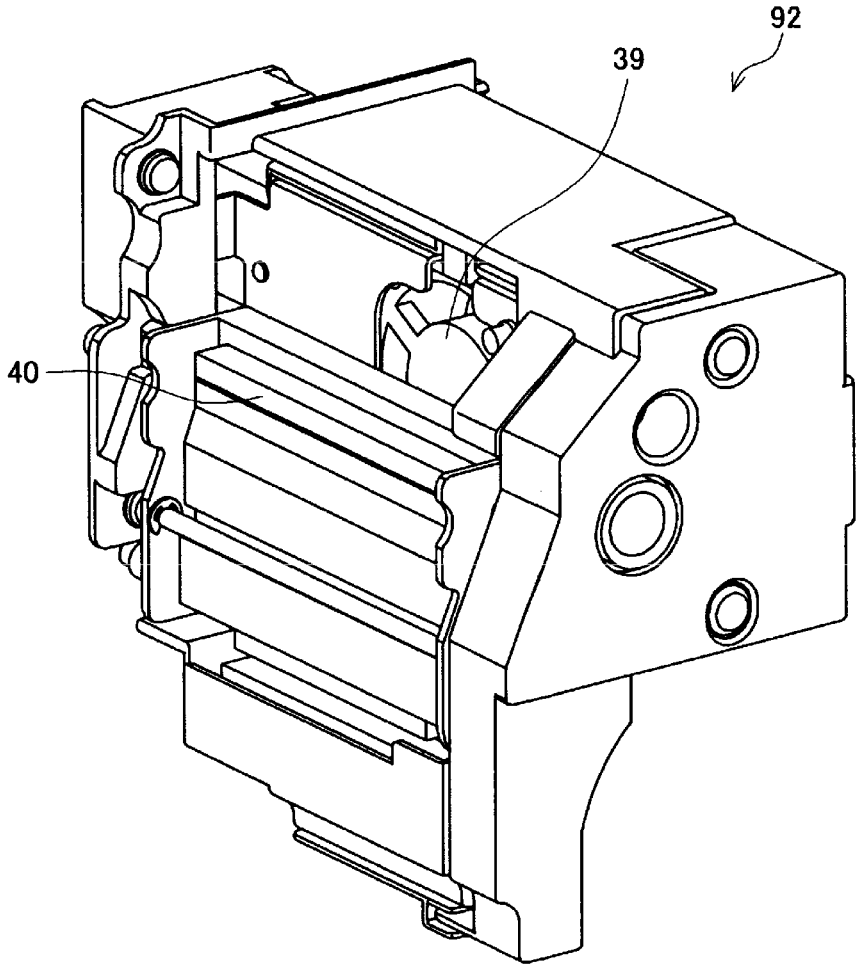
FIG. 11 is an external view of a third unit integrated to incorporate the thermal head into the printing apparatus.

The above-mentioned thermal head 40 is disposed in the position opposed to the platen roller 45 with a transport path of the transfer film 46 and ink ribbon 41 therebetween. The thermal head 40, members related to heating and cooling fan 39 are integrated into the third unit 92 as shown in FIG. 11, and are disposed opposite the first unit 90.

The first unit 90 collectively holds the platen roller 45, peeling roller 25 and tension receiving member 52A varying in position by printing operation in the movable bracket 50A, and thereby eliminates the need of position adjustments among the members. Moreover, by shifting the bracket 50A by rotation of the cam 53, it is possible to shift the members to predetermined positions. Further, since the bracket 50A is provided, it is possible to store in the same unit as that of the fixed film transport roller 49, the transport drive portion by the film transport roller 49 required to transport the transfer film with accuracy and the transfer position regulation portion by the platen roller 45 are included in the same unit, and therefore, the need is eliminated for position adjustments between both portions.

As shown in FIG. 10, in the second unit 91, the cam shaft 82 installed with the cam 53 is inserted in a unit frame body 55, and is coupled to an output shaft of the drive motor 54. Then, the second unit 91 supports the bracket 50 in the unit frame body 55 movably to come into contact with the cam 53, and to the bracket 50 are fixed the support shaft 58 that supports the pinch roller support member 57 rotatably and the tension receiving member 52.

In the pinch roller support member 57, the spring members 51*a*, 51*b* are attached to the support shaft 58, and their end portions are respectively brought into contact with the opposite ends of the pinch roller support member 57 that supports the pinch rollers 32*a*, 32*b* to bias to the direction of the film transport roller 49. In the pinch roller support member 57, the support shaft 58 is inserted in the long holes 76, 77, and is fixed and supported in the center portion by the bracket 50.

A spring 89 for biasing the pinch roller support member 57 toward the bracket 50 is provided between the bracket 50 and the pinch roller support member 57. By this spring 89, the pinch roller support member 57 is biased in the direction of moving backward from the film transport roller 49 of the first unit 90, and therefore, it is possible to easily pass the transfer film 46 through between the first unit 90 and the second unit 91 in setting the transfer film cassette in the printing apparatus 1.

The second unit 91 holds the pinch rollers 32*a*, 32*b*, and tension receiving member 52 varying in position corresponding to printing operation in the bracket 50A, shifts the pinch rollers 32*a*, 32*b* and tension receiving member 52 by shifting the bracket 50A by rotation of the cam 53, and thereby simplifies position adjustments between the rollers and member, and position adjustments between the pinch rollers 32*a*, 32*b* and the film transport roller 49. Such a second unit 91 is disposed opposite the first unit 90 with the transfer film 46 therebetween.

By thus making the units, it is also possible to pull each of the first unit 90, second unit 91 and third unit 92 out of the main body of the printing apparatus 1 as in the cassette of each of the transfer film 46 and ink ribbon 41. Accordingly, in replacing the cassette due to consumption of the transfer film 46 or ink ribbon 41, when the units 90, 91 and 92 are pulled out as required, it is possible to install the transfer film 46 or ink ribbon 41 readily inside the apparatus in inserting the cassette.

As described above, by combining the first unit 90 into which are integrated the platen roller 45, bracket 50A, cam 53A, and platen support member 72, and the second unit 91 into which are integrated the pinch rollers 32*a*, 32*b*, bracket 50, cam 53 and spring members 51, and placing and installing the third unit 92 with the thermal head 40 attached thereto opposite the platen roller 45, it is possible to perform assembly in manufacturing the printing apparatus and adjustments in maintenance with ease and accuracy. Moreover, by integrating, it is possible to perform removal from the apparatus with ease, and the handleability as the printing apparatus is improved.

Described next is control and electric system of the printing apparatus 1. As shown in FIG. 12, the printing apparatus 1 has a control section 100 that performs operation control of the entire printing apparatus 1, and a power supply section 120 that transforms utility AC power supply into DC power supply that enables each mechanism section, control section and the like to be driven and actuated.

<Control Section>

As shown in FIG. 12, the control section 100 is provided with a microcomputer 102 that performs entire control processing of the printing apparatus 1. The microcomputer 102 is comprised of a CPU that operates at fast clock as the central processing unit, ROM in which are stored programs, pattern data described later and the like of the printing apparatus 1, RAM that works as a work area of the CPU, and internal buses that connect the components.

The microcomputer 102 is connected to external buses. The external bus is connected to an interface, not shown, to communicate with the higher apparatus 201, and buffer memory 101 to temporarily store printing data to print on the card Ca, recording data to magnetically or electrically record in a magnetic stripe or stored IC of the card Ca, and the like.

Further, the external bus is connected to a sensor control section 103 that controls signals from various sensors, an actuator control section 104 that controls motor drivers and the like for supplying drive pulses and drive power to respective motors, a thermal head control section 105 to control thermal energy to the heating elements constituting the thermal head 40, an operation display control section 106 to control the operation panel section 5, and the above-mentioned information recording section A.

(Power Supply Section)

The power supply section 120 supplies operation/drive power to the control section 100, thermal head 40, heat roller 33, operation panel section 5, information recording section A and the like.

<Operation>

Next, referring to a flowchart and the like, printing operation by the printing apparatus 1 of this Embodiment will be described with emphasis on the CPU (hereinafter, simply referred to as CPU) of the microcomputer 102. In addition, to simplify the description, the description will be given while assuming that initial setting processing for decompressing programs and the like stored in the ROM in the RAM, and positioning each of members constituting the printing apparatus 1 in a home (initial) position is finished, and that printing data (color component printing data of Y, M, C and printing data of Bk), magnetic or electric recording data and the like are already received from the higher apparatus 201.

(Normal Printing)

Figure 13:
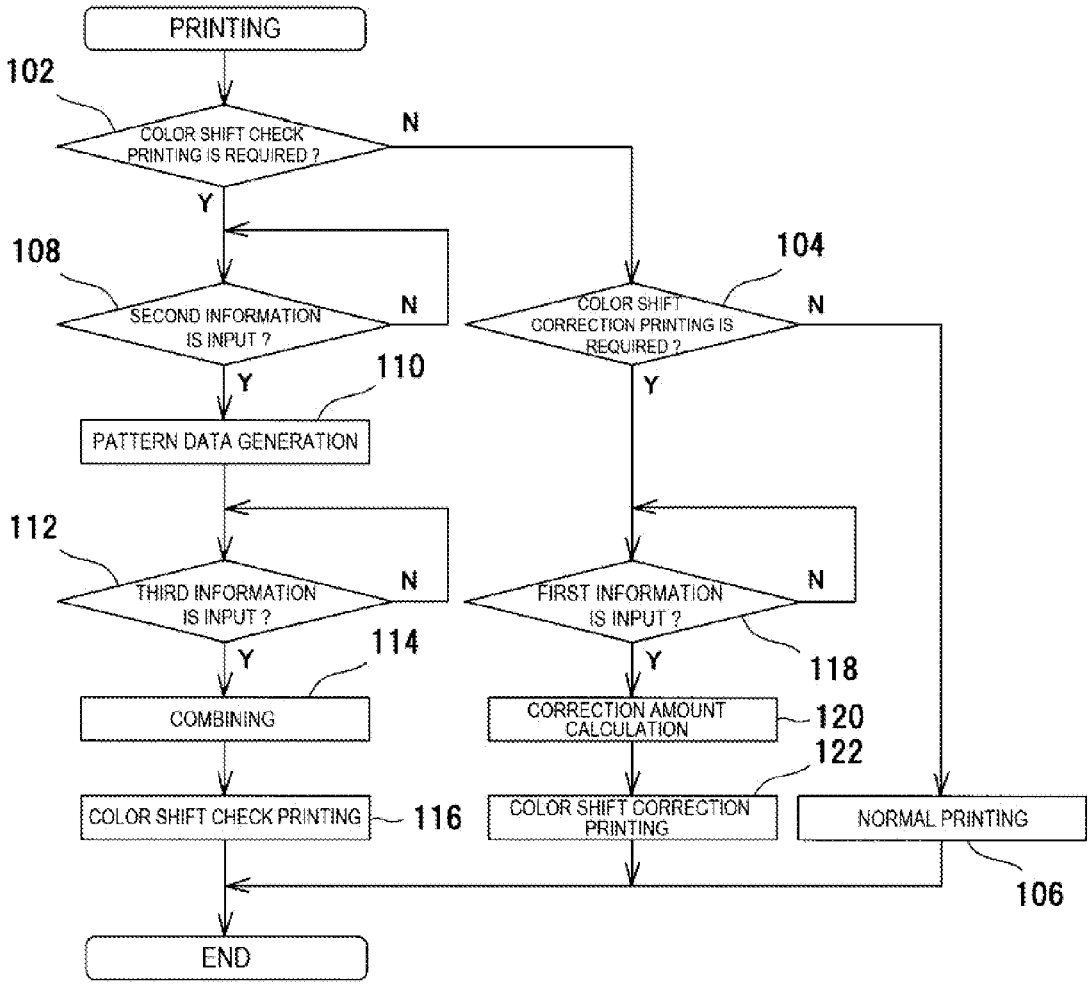
FIG. 13 is a flowchart of a printing routine executed by a CPU of a microcomputer of the control section in the printing apparatus of this Embodiment.

As shown in FIG. 13, in a printing routine, in step 102, the CPU judges whether or not color shift check printing is required. In a negative judgement, in step 104, the CPU judges whether or not color shift correction printing is required, and in a negative judgement, in step 106, the CPU executes normal printing processing. In this Embodiment, such a judgement is made based on information input from the operation panel section 5 or higher apparatus 201 by an operator. In addition, the printing apparatus 1 of this Embodiment is capable of performing three types of printing of normal printing (see step 106), color shift check printing (see step 116) and color shift correction printing (see step 122), and meanings of the "color shift check printing" and "color shift correction printing" will be described while comparing with the "normal printing" after describing the normal printing processing of step 106.

In the normal printing processing in step 106, first, in the image formation section B1, the CPU performs image formation (printing) processing for forming an image (mirror image) in a predetermined region of the transfer film 46. In other words, by controlling the thermal head 40 of the image formation section B1 according to the color component printing data of Y, M, C and printing data of Bk stored in the buffer member 101, the CPU superimposes printing images due to Y, M, C and Bk inks of the ink ribbon 41 on the transfer film 46 to form. At this point, the CPU controls the stepping motor, not shown, which drives the film transport roller 49 so that respective printing images of Y, M, C and Bk inks overlap one another in the predetermined region of the transfer film 46 i.e. respective printing start positions of the printing images are the same.

In other words, the CPU positions the transfer film 46 in the printing start position with respect to the printing image of the printing data of Y to start printing, transports the transfer film 46 backward to the above-mentioned printing preparation position after printing with the printing data of Y, shifts from the printing preparation position to the printing start position to start printing with the printing data of M, transports the transfer film 46 backward to the printing preparation position after printing with the printing data of M, shifts from the printing preparation position to the printing start position to start printing with the printing data of C, transports the transfer film 46 backward to the printing preparation position after printing with the printing data of C, shifts from the printing preparation position to the printing start position, and starts printing with the printing data of Bk.

Further, the CPU outputs the printing data to the thermal head 40 for each line via the thermal head control section 105, and thereby selectively heats the heating elements lined in the main scanning direction to drive the thermal head 40. In addition, in this Embodiment, after forming an image of one surface side of the card Ca in the predetermined region of the transfer film 46, an image of the other surface side is formed in the next region of the transfer film 46.

In parallel with the image formation processing, the CPU feeds out the card Ca from the media storage section C, based on the magnetic or electric recording data performs recording processing on the card Ca in one of the magnetic recording section 24, non-contact type IC recording section 23, and contact type IC recording section 27 constituting the information recording section A, and then, transports the card Ca to the transfer section B2.

Next, in the transfer section B2, the CPU performs transfer processing for transferring the image formed on the transfer film 46 to the card Ca. In this transfer processing, the CPU controls so that the card Ca and the image formed in the predetermined region (or the next region) of the transfer film 46 arrive at the transfer section B2 in synchronization with each other. In addition, after transferring the image to one surface of the card Ca, the CPU transports the card Ca to the rotating unit F side to rotate the card Ca 180°, and transfers the image for the other surface to the other surface of the card Ca.

Next, the CPU corrects a curl of the card Ca occurring in thermal transfer with the heat roller 33 in the decurl mechanism 36, then discharges the card Ca toward the storage stacker 60, and finishes the printing routine.

(Color Shift Check Printing)

Figure 14:
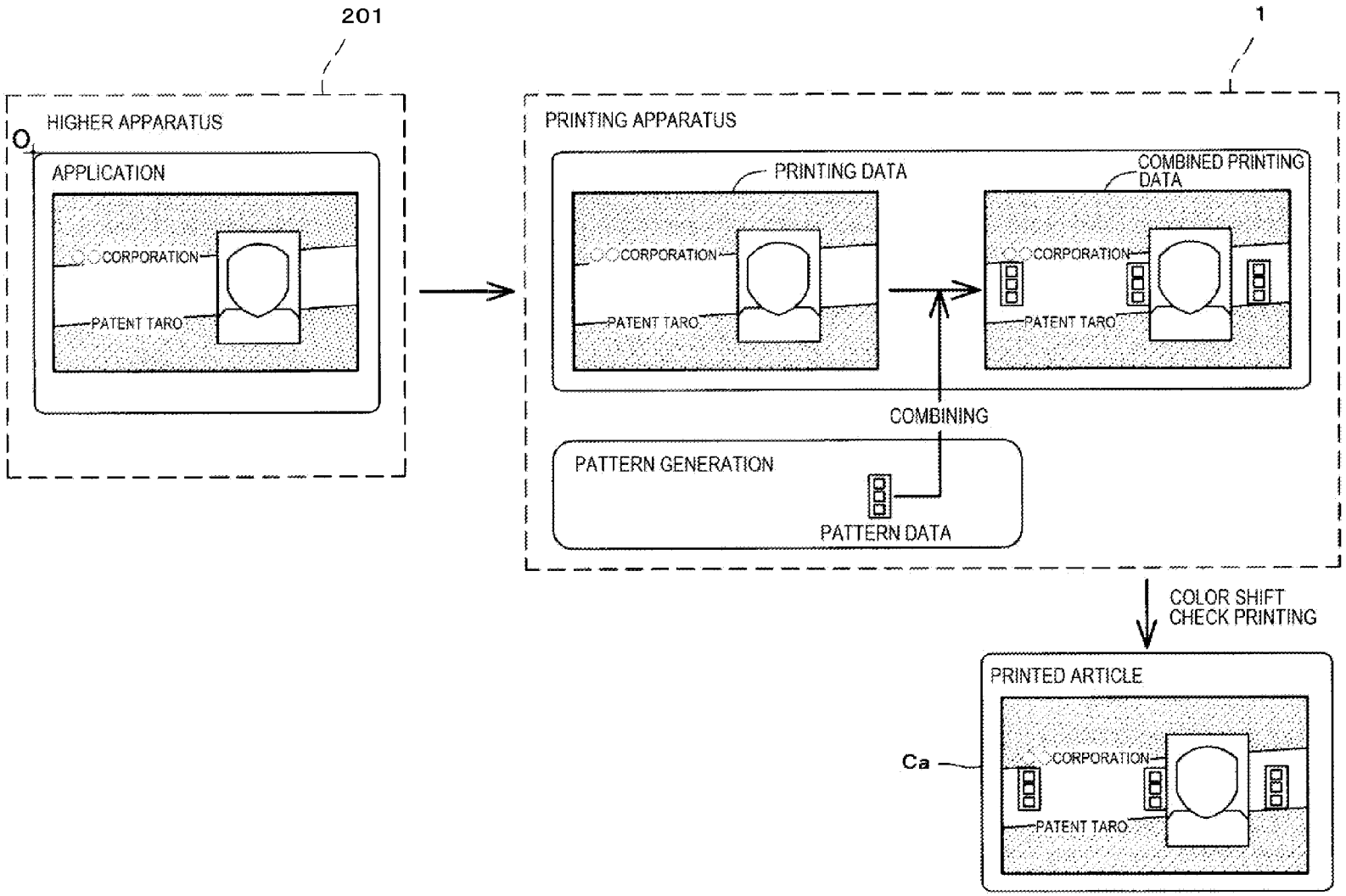
FIG. 14 is an explanatory view schematically showing a concept of color shift check printing.

The color shift check printing will be described next. The color shift check printing is briefly printing performed to check an extent of color shift caused by properties of (the printing image of) printing data, and the details are as described below. FIG. 14 schematically shows a concept of color shift check printing. In the upper left in FIG. 14 is illustrated a design created by application software installed in the higher apparatus 201. For example, such a design is capable of being created by designating positions and sizes of various images (for example, "○○ Corporation") with respect to the origin point O (0, 0) of the card Ca, and is first formed with image data of R (Red), G (Green) and B (Blue) and image data of Bk, and in this Embodiment, with the above-mentioned application software or another application software, the image data of RGB is converted into printing data of YMC, while the image data of Bk is used as printing data of Bk without modification.

On the other hand, in the upper right in FIG. 14 is illustrated a state in which the printing data (printing data of MYC and Bk) received from the higher apparatus 201 is stored in the buffer memory 101 of the printing apparatus 1. Pattern data of a pattern comprised of respective colors of inks of the ink ribbon 41 is beforehand stored in the ROM of the microcomputer constituting the control section 100. The pattern data is decompressed in the RAM by the initial setting processing as described above.

Figure 15:
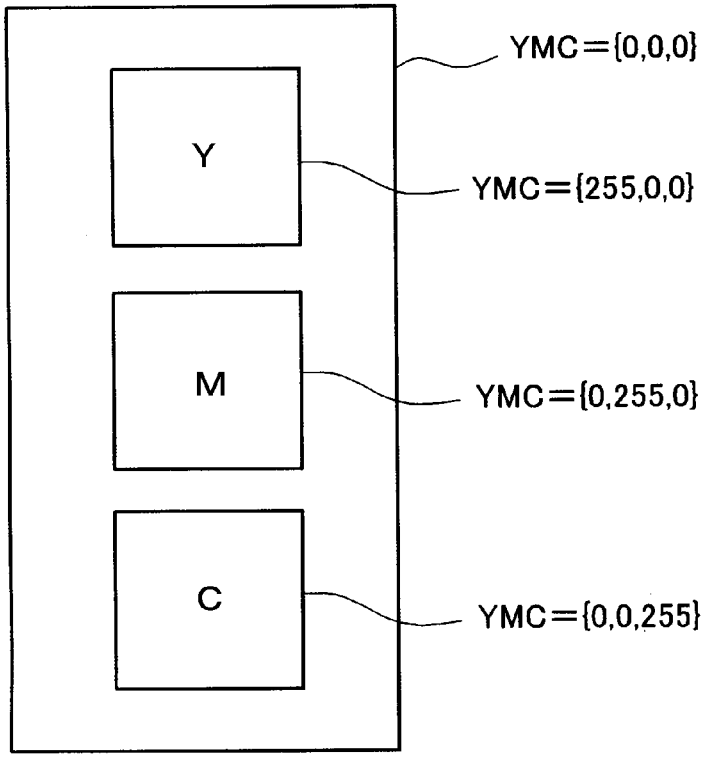
FIG. 15 is an explanatory view schematically showing an example of a pattern.

FIG. 15 schematically shows an example of such a pattern. In the pattern of this example, inside a rectangular region with each of gradation values of Y, M, C being "0", square-shaped Y (gradation value of 255), M (gradation value of 255) and C (gradation value of 255) inks are spaced apart from one another and disposed in a line in the printing main scanning direction (vertical direction in FIG. 15) of the thermal head 40 constituting the image formation section B1. In addition, the above-mentioned pattern data is stored in the ROM as Y pattern data, M pattern data and C pattern data obtained by performing color separation on the pattern for each of YMC.

A single or plurality of patterns (types of pattern data) may be stored in the ROM. This Embodiment uses the ink ribbon 41 with inks of Y, M, C, and Bk arranged in a face sequential manner, and by replacing the ink ribbon cassette 42, for example, it is also possible to use an ink ribbon with inks of Y, M, C, gold and Bk arranged in a face sequential manner. In such a case, to check a position shift of the gold ink, with the description given according to the example in FIG. 15, inside the rectangular region with each of gradation values of Y, M, C being "0", for example, the square-shaped gold ink may be disposed below the square-shaped C ink. Further, also when the ink ribbon 41 is used, in the case of correcting shifts of color printing with Y, M, C and black character printing with Bk, as a pattern, inside the rectangular region with each of gradation values of Y, M, C being "0", for example, the square-shaped Bk ink may be disposed below the square-shaped C ink.

The pattern data which is stored in the ROM and decompressed in the RMA may be used without modification, or new pattern data may be generated by transforming the pattern data decompressed in the RAM according to second information (also see step 108 of FIG. 13) described later (details will be described later.).

Further, in the upper right of FIG. 14 is illustrated combined printing data obtained by combining the printing data and the pattern data. In this example, for the printing image of the printing data, three printing images of the pattern data are disposed respectively (to the right, center and left of the printing image of the printing data) apart from one another in the printing sub-scanning direction (horizontal direction in FIG. 14) of the thermal head 40.

FIG. 14 shows the example in which a plurality of (three) printing images of the pattern data is disposed in the printing image of the printing data, and a single printing image of the pattern data may be disposed. Further, the number of printing images of the pattern data may be beforehand determined. Furthermore, the position in which the printing image of the pattern data is disposed may be beforehand determined, or may be identified according to third information (see also step 112 of FIG. 13) described later (details will be described later.).

FIG. 14 shows the example of the combined printing data obtained by combining the printing data and the pattern data so that the printing image of the pattern data overlaps a part of the printing image of the printing data. In the combined printing data, the printing data and the pattern data is combined so that a portion of the printing image of the printing data overlapping the printing image of the pattern data is invisible.

An example of such a combining method will be described. First, (1) the concentration information is deleted inside the region of each printing image of printing data of YMC and Bk overlapping the printing image of the pattern data. In other words, the printing data of YMC and Bk is respectively corrected so that a gradation value of a region of the printing image of the printing data of Y overlapping the printing image (rectangular region) of the pattern data is "0", a gradation value of a region of the printing image of the printing data of M overlapping the printing image of the pattern data is "0", a gradation value of a region of the printing image of the printing data of C overlapping the printing image of the pattern data is "0", and that a gradation value of a region of the printing image of the printing data of Bk overlapping the printing image of the pattern data is "0".

Next, (2) the printing image of the pattern data is superimposed on a printing image of the corrected printing data. In other words, in the region of the printing image of the printing data of Y with the gradation value corrected to "0", the gradation value of a region corresponding to the square-shaped region of the Y ink of the superimposed pattern data is changed to "255". In the region of the printing image of the printing data of M with the gradation value corrected to "0", the gradation value of a region corresponding to the square-shaped region of the M ink of the superimposed pattern data is changed to "255". In the region of the printing image of the printing data of C with the gradation value corrected to "0", the gradation value of a region corresponding to the square-shaped region of the C ink of the superimposed pattern data is changed to "255". In addition, for the printing data of Bk, a change to a gradation value of "255" as in the printing data of YMC is not made.

In this Embodiment, the combined printing data is formed as described above, but the present invention is not limited to the exemplified combining method as described above. In addition, in order to make the concept of the combined printing data easy to grasp, FIG. 14 shows the state in which printing images of printing data of YMC and Bk are superimposed.

As shown in the lower right of FIG. 14, by superimposing printing images of the combined printing data with YMC and C inks on the transfer film 46 to form, the color shift check printing is performed. Accordingly, the color shift check printing is common to the normal printing in the respect that the stepping motor, not shown, which drives the film transport roller 49 is controlled so that respective printing start positions of the printing images of YMC and Bk are the same, and in contrast to the normal printing in which the printing is performed on the transfer film 46 according to the printing data, is different in the respect that the printing is performed on the transfer film 46 according to the combined printing data obtained by combining the printing data and the pattern data so that the printing image of the pattern data overlaps apart of the printing image of the printing data.

Returning to the description of FIG. 13 based on the above, in an affirmative determination in step 102, the CPU waits until the second information is input in step 108. The second information includes at least one piece of information of information to identify the pattern, information concerning the size of the printing image of the pattern data and information concerning gradations of inks constituting the pattern. In addition, in this Embodiment, the operator inputs the second information form the operation panel section 5 or the input apparatus 203 of the higher apparatus 201 (the same in the first and third information described later).

The information to identify the pattern is to check (identify) which pattern the operator desires in the case of storing a plurality of items (types) of pattern data in the microcomputer 102 constituting the control section 100. At this point, to assist the operator, the image, explanation and the like of the pattern may be displayed in the operation panel 5 or the monitor 202 of the higher apparatus 202.

The information concerning the size of the printing image of the pattern data may be information for indicating percentages by which the size of the printing image is increased or decreased over the printing image of the pattern data stored in the ROM, as well as the dimensions of the printing image itself. At this point, to be widely known, for example, the operation panel section 5 or the monitor 202 of the higher apparatus 201 may display check boxes or the like to select from among discrete scaling factors of 80%, 100%, 120%, 150% and the like.

The information concerning gradations of the inks constituting the pattern is "255" in the example as shown in FIG. 15, and may be gradation values except "255" or gradation values of the inks may be different from one another. Further, in consideration of the entire impression of the printing image to the operator (such an impression is capable of being obtained in creating the design with the application software shown in the upper left of FIG. 14), for example, the impression is sorted into "printing image with a high concentration", "printing image with an intermediate concentration", and "printing image with a low concentration", and the information may be such information. In this case, gradation values corresponding to the "printing image with a high concentration", "printing image with an intermediate concentration", and "printing image with a low concentration" may be beforehand stored in the ROM to change gradation values of the inks constituting the pattern corresponding to the information (for example, "printing image with a high concentration") selected by the operator.

When the second information is input in step 108, in next step 110, the CPU identifies the pattern in the case where the information to identify the pattern is input, changes the size of the printing image of the pattern data in the case where the information concerning the size of the printing image of the pattern data is input, changes gradation values of the pattern in the case where the information concerning gradations of the inks constituting the pattern is input, and thereby generates the pattern data (also see "pattern generation" in the upper right of FIG. 14). In addition, when one of the information to identify the pattern, the information concerning the size of the printing image of the pattern data, and the information concerning gradations of the inks constituting the pattern is not input from the operator, the CPU may use a beforehand determined pattern, the beforehand determined size (for example, 100%) of the printing image of the pattern data, and the beforehand determined gradation value (for example, 255).

Next, in next step 112, the CPU waits until the third information is input. The third information includes at least one of the information concerning the number of printing images of the pattern data and the information concerning the position of the printing image of the pattern data on the card Ca.

The information concerning the number of printing images of the pattern data is "3" in the example as shown in FIG. 14, and the operator may select the number of images. Further, the position in which the printing image of the pattern data is disposed may be beforehand set corresponding to the number of images.

The information concerning the position of the printing image of the pattern data on the card Ca is the left, center and right in the center in the vertical direction of the card Ca in the example as shown in FIG. 14, and the operator may specify the position. As the information concerning the position of the printing image of the pattern data on the card Ca, as well as the position (for example, position of the printing image of the pattern data with respect the origin point O (0, 0) of the card Ca (see the upper left of FIG. 14)) on the card Ca, the operator may select from among a plurality of beforehand set positions. At this point, to assist the operator, the operation panel section 5 or the monitor 202 of the higher apparatus 201 may display the position of the printing image of the pattern data with respect to the printing image of the printing data.

The information concerning the position of the printing image of the pattern data on the card Ca is particularly important to correct the color shift caused by properties of the printing data. In other words, for example, when the color shift occurs in an identification photograph, logo and the like, the color shift is more conspicuous than in the other portion, and it is easily judged that the printing quality is low. As already shown as the other example, this is the same as in the position shift of the portion printed with gold. Therefore, when an identification photograph exists, the printing image of the pattern data may be disposed near the identification photograph (or a position near the identification photograph may be selected from among a plurality of beforehand set positions) to check an extent of the color shift.

When the third information is input in step 112, the CPU combines the printing data and the pattern data so that the printing image of the pattern data overlaps a part of the printing image of the printing data according to the third information input in step 114, performs the color shift check printing processing in step 116, and finishes the printing routine. The details of steps 114 and 116 are already described, and therefore, are omitted to avoid redundancy.

(Color Shift Check)

Figure 16:
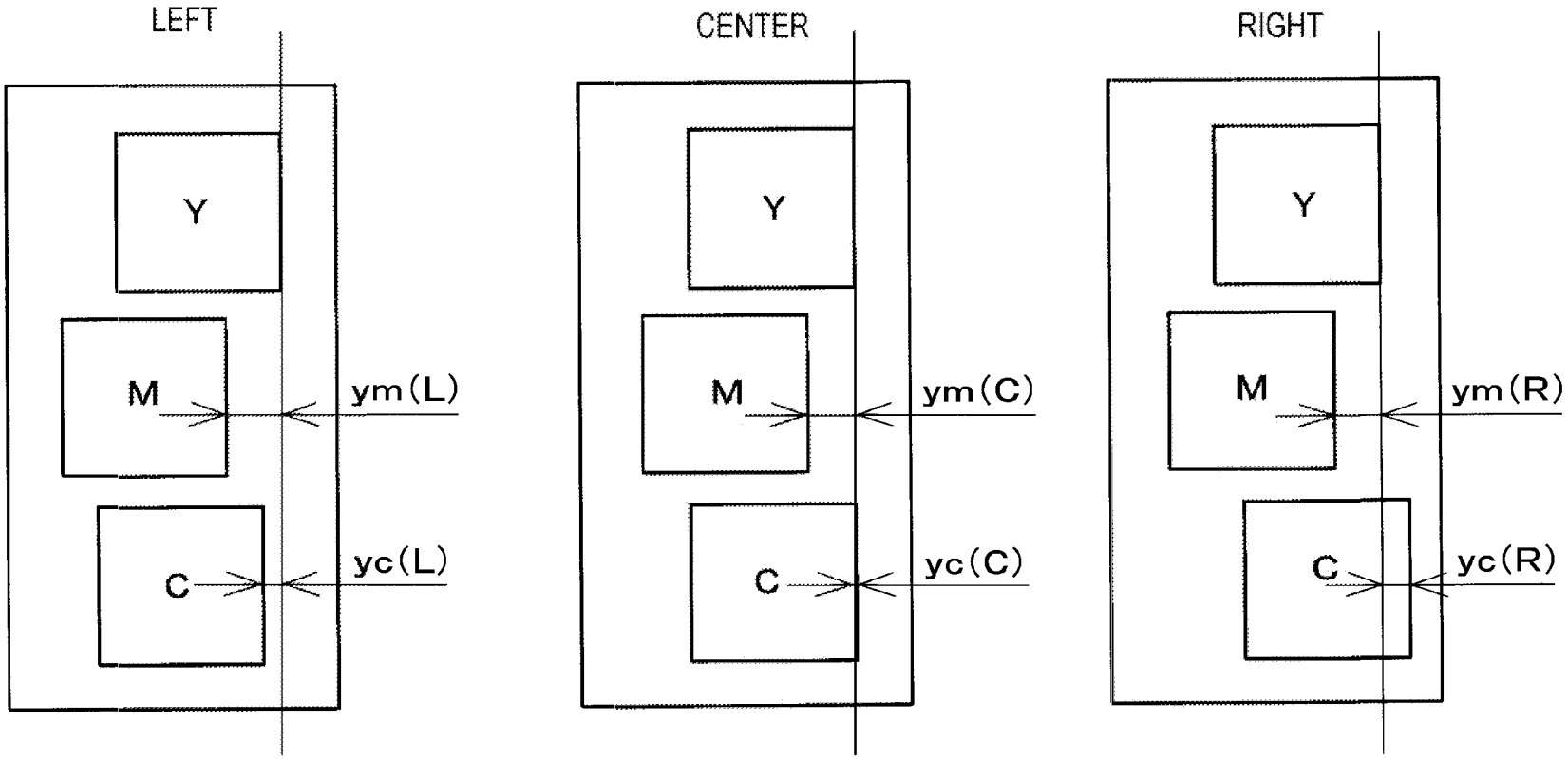
FIG. 16 is an explanatory view schematically showing shifts in respective colors of inks occurring in a printing image of pattern data in performing the color shift check printing.

FIG. 16 is an explanatory view schematically showing shifts in respective colors of inks occurring in the printing images of the pattern data disposed on the right side, center and left side corresponding to FIG. 14 in performing the color shift check printing. By comparing with the pattern as shown in FIG. 15 disposed in a line in the printing main scanning direction of the thermal head 40 constituting the image formation section B1, it is possible to grasp extents of shifts (check the color shift) in respective colors of inks occurring in the printing images of the pattern data disposed in respective positions.

In FIG. 16, a shift amount of the ink of M (Magenta) with respect to the ink of Y (Yellow) disposed on the right side in FIG. 14 is represented as ym(R), a shift amount of the ink of C (Cyan) with respect to the ink of Y is represented as yc(R), a shift amount of the ink of M with respect to the ink of Y disposed in the center in FIG. 14 is represented as ym(C), a shift amount of the ink of C with respect to the ink of Y is represented as yc(C), a shift amount of the ink of M with respect to the ink of Y disposed on the left side in FIG. 14 is represented as ym(L), and a shift amount of the ink of C with respect to the ink of Y is represented as yc(L). In addition, in this Embodiment, since the printing images are formed in the order of YMC according to the order of inks of YMC arranged in the ink ribbon 41, shifts amounts of inks of M and C are determined with respect to the ink of Y, but the present invention is not limited thereto.

(Color Shift Correction Printing)

The color shift correction printing will be described next. The color shift correction printing is briefly printing where the color shift caused by properties of the printing data is corrected, and the details are as described below. The operator acquires the shift amount such as the above-mentioned ym(R) as described above as a numeric value using a scale or the like. A magnifier may be used when necessary. As the first information concerning the shift in respective colors of inks constituting the pattern, more specifically, the shift amount in the printing sub-scanning direction of the thermal head 40 of the ink of the other color with respect to the ink of one color among the inks constituting the pattern (printing image of the pattern data) as the first information, particularly, in the example as shown in FIG. 16, values of ym(R), yc(R), ym(C), yc(C), ym(L) and yc(L) are input to the printing apparatus 1 as the first information. As described above, in this Embodiment, the operator inputs the first information from the operation panel section 5 or the input apparatus 203 of the higher apparatus 201.

The first information may include designation of a color shift correction method. As examples of the designation of the color shift method, for example, there are methods of designating so as to minimize the shift amounts of the printing images of printing data of YMC on the whole, designating so as to minimize the shift amount of the pattern disposed on the right side, designating so as to minimize the shift amounts on the right side and center (designating the shift amounts near the identification photograph (see FIG. 14)), and the like. In addition, in an aspect that the first information does not include designation of the color shift correction method, it may be set that the shift amounts of the printing images of printing data of YMC are minimized on the whole.

Returning to the description of FIG. 13 based on the above, in an affirmative determination in step 104, the CPU waits until the first information is input in step 118. In the following description, the description will be given more specifically on the case where values of the above-mentioned shift amounts of ym(R), yc(R), ym(C), yc(C), ym(L) and yc(L) and the correction method are designated as the first information.

When the first information is input (including designation of the correction method) in step 118, in step 120, the CPU calculates a correction amount to the transfer film 46 of the thermal head 40 of the printing image to print with each of M and C.

For example, when the designation is made to minimize the entire shift amounts of the printing images of printing data of YMC as the correction method, the CPU calculates correction amount (M)={ym(R)+ym(C)+ym(L)}/3 as the correction amount (M) of the printing data of M, and correction amount (C)={yc(R)+yc(C)+yc(L)}/3 as the correction amount (C) of the printing data of C. These correction amounts indicate average values of respective shift amounts in three portions. When the designation is made to minimize the shift amount of the pattern disposed on the right side as the correction method, the CPU calculates correction amount (M)=ym (R) as the correction amount (M) of the printing data of M, and correction amount (C)=yc(R) as the correction amount (C) of the printing data of C. When the designation is made to minimize the shift amounts on the right side and center, the CPU calculates correction amount (M)={ym(R)+ym(C)}/2 as the correction amount (M) of the printing data of M, and correction amount (C)={yc(R)+yc(C)}/2 as the correction amount (C) of the printing data of C. Accordingly, in step 120, first, the correction amounts of printing start positions on the transfer film 46 of the printing images of inks of M, C are calculated so as to decrease the shift amounts in respective colors of the inks constituting the pattern in the printing sub-scanning direction of the thermal head 40.

In addition, as can be seen from the above-mentioned calculation equations, in the case of designating to minimize the shift amount of the pattern disposed on the right side as the correction method, it is not necessary to input shift amounts of ym(C), ym(L), yc(C) and yc(L), and in the case of designating to minimize the shift amounts on the right side and center, it is not necessary to input shift amounts of ym(L) and yc(L). Accordingly, the shift amount in the particular position may be input according to designation of the correction method.

In the normal printing, a transport amount from the above-mentioned printing preparation position to the printing start position is set at a predetermined value (the number of pulses output to the stepping motor, not shown, is determined.) In contrast thereto, in the color shift correction printing, the CPU corrects the printing start position of the printing image of the printing data of M on the transfer film 46 corresponding to the correction amount (M) calculated in the above-mentioned calculation equation, and corrects the printing start position of the printing image of the printing data of C on the transfer film 46 corresponding to the correction amount (C) calculated in the above-mentioned calculation equation. Therefore, in step 120, the CPU subsequently calculates the numbers of pulses of the stepping motor, not shown, which drives the film transport roller 49 respectively corresponding to the correction amount (M) and correction amount (C).

In next step 122, according to the correction amount (M) and correction amount (C) calculated in step 120, the CPU makes corrections to the printing start positions on the transfer film 46 of the printing image of the printing data of M and the printing image of the printing data of C to execute the color shift correction printing processing, and finishes the printing routine. Accordingly, the color shift correction printing is common to the normal printing in the respect of printing according to the printing data, without using the combined printing data as in the color shift check printing, and is different from the normal printing in the respect of correcting the printing start positions on the transfer film 46 with the thermal head 40 of the printing images of the printing data of M, C.

In addition, the CPU controls the stepping motor, not shown, which drives the film transport roller 49 so as to position the transfer film 46 in the printing start position with respect to the printing image of the printing data of Y to start printing, transport the transfer film 46 backward to the printing preparation position after printing with the printing data of Y, shift the printing start position on the transfer film 46 with the thermal head 40 of the printing image of the printing data of M by the correction amount (M) from the printing preparation position to the printing start position to start printing with the printing data of M, transport the transfer film 46 backward to the printing preparation position after printing with the printing data of M, shift the printing start position on the transfer film 46 with the thermal head 40 of the printing image of the printing data of C by the correction amount (C) from the printing preparation position to the printing start position to start printing with the printing data of C, transport the transfer film 46 backward to the printing preparation position after printing with the printing data of C, and shift to the printing start position from the printing preparation position to start printing with the printing data of Bk.

<Effects and Others>

The effects and others of the printing apparatus 1 of this Embodiment will be described next.

In the printing apparatus 1 of this Embodiment, in printing on the transfer film 46 according to the printing data in the image formation section B1, the printing start positions on the transfer film 46 with the thermal head 40 of the printing images respectively to print with inks of Y, M, C are corrected according to the first information. Therefore, it is possible to correct the color shift caused by properties of the printing data. Additionally, in the conventional printing apparatus, the operation method is common in which the personal information such as an identification photograph and name is only replaced in the particular design to issue a large amount of cards, and in such operation, the printing apparatus 1 of this Embodiment provides the function for correcting the color shift caused by the entire design including the personal information (see the color shift correction printing processing in steps 104 to 122 in FIG. 13), and in this respect, is expected to improve the printing quality for each card Ca.

Further, in the printing apparatus 1 of this Embodiment, since a plurality of printing images of the pattern data is disposed (see the combined printing data in FIG. 14), it is possible to correct the color shift so as to decrease the color shift in a region (for example, identification photograph and logo) important in the design (see steps 118 and 120 in FIG. 13). Accordingly, it is possible to focus on the color shift and position shift of a portion which has a conspicuous color shift and is easily judged as being low in printing quality (for example, case of using gold ink) to correct.

In addition, this Embodiment exemplifies the printing apparatus 1 of the indirect printing scheme, but the present invention is not limited thereto, and the invention is applicable also to a printing apparatus of the direct printing scheme. Further, the card Ca is exemplified as the printing medium, and the invention is applicable to other printing media such as a sheet and film. Furthermore, this Embodiment shows the example where the image formation section B1 forms an image of one surface side of the card Ca in a predetermined region of the transfer film 46, and then, forms an image of the other surface side in a next region of the transfer film 46, the transfer section B2 transfers the image to one surface of the card Ca, the card Ca is then transported to the rotating unit F side and is rotated 180°, and the image for the other surface is transferred to the other surface of the card Ca, and another configuration may be adopted where the image formation section B1 forms an image of one surface side of the card Ca in a predetermined region of the transfer film 46, after the transfer section B2 transfers the image to one surface of the card Ca or during transfer, the image formation section B1 forms an image of the other surface side in a next region of the transfer film 46, the card Ca is transported to the rotating unit F side and is rotated 180° after transferring the image to one surface of the card Ca, and the transfer section B2 transfers the image for the other surface to the other surface of the card Ca.

Further, this Embodiment shows the example of inputting the first to third information from the input apparatus 203 of the higher apparatus 201 or the operation panel section 5, but the present invention is not limited thereto. For example, in the case where the printing apparatus 1 constitutes a member of a local network, the information may be input from a personal computer connected to the local network other than the higher apparatus. Furthermore, this Embodiment shows the example of receiving the printing data from the higher apparatus 201, but the present invention is not limited thereto. For example, in the case of a configuration where the printing apparatus 1 is capable of connecting to an external storage apparatus such as USB and memory card, the apparatus 1 is capable of acquiring the printing data by reading the information stored in the external storage device. Moreover, instead of the printing data, the apparatus 1 may receive the image data from the higher apparatus 201. In this case, the image data received on the printing apparatus 1 side can be converted into the printing data.

Furthermore, as shown in FIG. 15, this Embodiment shows the example where square-shaped Y, M and C inks are disposed apart from one another in a line in the printing main scanning direction of the thermal head 40 constituting the image formation section B1 inside the rectangular region with each of gradation values of YMC of "0", but the present invention is not limited thereto, and various modifications are available. For example, the rectangular region may not be provided. Further, instead of the square shape, various shapes such as polygons (including a rectangle), circles (including an ellipse) and the shape of a star may be made. Furthermore, the YMC inks may be disposed to adjoin without being spaced. Still furthermore, the YMC inks may be disposed in a plurality of lines in the printing main scanning direction of the thermal head 40.

Moreover, this Embodiment shows the example of storing the pattern data in the ROM of the microcomputer 102 of the control section 100, but the pattern data does not need to be always stored in the ROM of the microcomputer 102. For example, the ink ribbon cassette 42 has a storage section such as an IC for storing the pattern data, and the CPU may read the pattern data stored in the IC of the ink ribbon cassette 42. In such an aspect, since it is not necessary to store various items of pattern data in the ROM of the microcomputer 102, it is possible to decrease the capacity of the ROM of the microcomputer 102, and to make a check on the color shift and position shift and the like with the most suitable pattern data for the ink ribbon in the case of putting a new ink ribbon cassette on the market.

Accordingly, it is possible to include, in the scope of claims, "a printing apparatus provided with an attachable/detachable ink ribbon cassette including an ink ribbon with a plurality of color inks repeated in a face sequential manner and a storage section for storing pattern data of a pattern comprised of colors of the inks or a part of the colors, a printing section adapted to print on a medium using the inks of the ink ribbon according to printing data, a combining section adapted to combine the printing data and the pattern data so that a printing image of the pattern data stored in the storage section of the ink ribbon cassette overlaps a part of a printing image of the printing data, and a correction section adapted to correct a printing start position on the medium with the printing section of the printing image of at least one color ink among printing images to print respectively with the plurality of color inks, according to input first information that is information concerning a shift in respective colors of the inks or a part of the colors constituting the pattern occurring in printing on the medium with the printing section according to combined printing data combined in the combining section".

Then, this Embodiment exemplifies the ink ribbon cassette 42, but the present invention is not limited thereto, and it is indisputable that the invention is applicable to types of ink ribbons without using the cassette.

In addition, this application claims priority from Japanese Patent Application No. 2014-147873 incorporated herein by reference.

The invention claimed is:

1. A printing apparatus comprising:

a printing section adapted to print on a medium using a plurality of color inks according to printing data;

a storage/generation section adapted to store or generate pattern data of a pattern comprised of respective colors of the inks;

a combining section adapted to combine the printing data and the pattern data so that a printing image of the pattern data stored or generated in the storage/generation section overlaps a part of a printing image of the printing data; and a correction section adapted to correct a printing start position on the medium with the printing section of the printing image of at least one color ink among printing images to print respectively with the plurality of color inks, according to input first information that is information concerning a shift in respective colors of the inks constituting the pattern occurring in printing on the medium with the printing section according to combined printing data combined in the combining section.

2. The printing apparatus according to claim 1, wherein the combining section combines the printing data and the pattern data so that a plurality of printing images of the pattern data stored or generated in the storage/generation section is disposed apart from one another in a printing sub-scanning direction of the printing section.

3. The printing apparatus according to claim 1, wherein the combining section combines the printing data and the pattern data so that a portion of the printing image of the printing data overlapping the printing image of the pattern data is invisible.

4. The printing apparatus according to claim 1, wherein the pattern is disposed so that respective colors of the inks are placed in a line in a printing main scanning direction of the printing section.

5. The printing apparatus according to claim 1, wherein the storage/generation section generates the pattern data according to input second information including at least one piece of information of information to identify the pattern, information concerning a size of the printing image of the pattern data and information concerning a gradation of the inks constituting the pattern.

6. The printing apparatus according to claim 1, wherein the combining section combines the printing data and the pattern data according to input third information including at least one piece of information of information concerning the number of printing images of the pattern data and information concerning a position of the printing image of the pattern data on a printing medium.

7. The printing apparatus according to claim 1, wherein the correction section calculates a correction amount of the printing start position on the medium of the printing image of at least one color ink so as to decrease a shift amount in respective colors of inks constituting the pattern in a printing sub-scanning direction of the printing section.

8. The printing apparatus according to claim 1, wherein the first information is a shift amount in a printing sub-scanning direction of the printing section of the other color ink with respect to one color ink among the inks constituting the pattern.

* * * * *